US006371521B1

(12) United States Patent
Petkovsek

(10) Patent No.: US 6,371,521 B1
(45) Date of Patent: Apr. 16, 2002

(54) LABEL AND/OR FORM FOR SPECIAL SERVICE MAILING AND A METHOD OF ASSEMBLING A MAILPIECE REQUIRING SPECIAL MAILING SERVICES

(76) Inventor: Glenn Petkovsek, 2 Saverne Cir., Little Rock, AR (US) 72223

( * ) Notice: Subject to any disclaimer, the term of this patent is extended or adjusted under 35 U.S.C. 154(b) by 0 days.

(21) Appl. No.: 09/487,141

(22) Filed: Jan. 19, 2000

Related U.S. Application Data

(63) Continuation-in-part of application No. 09/413,400, filed on Oct. 6, 1999, which is a continuation-in-part of application No. 08/923,147, filed on Sep. 4, 1997, now abandoned, which is a continuation-in-part of application No. 08/714,679, filed on Sep. 16, 1996, which is a continuation-in-part of application No. 08/281,634, filed on Jul. 28, 1994, now Pat. No. 5,573,277.

(51) Int. Cl.[7] ..... B42D 15/00

(52) U.S. Cl. ..... 283/67; 283/70; 283/81; 283/116; 462/64; 462/65

(58) Field of Search ..... 283/79, 81, 101, 283/103, 56, 61, 62, 116, 117; 281/2, 5; 229/300, 92.8, 68.1, 70, 314, 315; 40/630, 638; 462/6, 8, 26, 64, 65

(56) References Cited

U.S. PATENT DOCUMENTS

| | | | |
|---|---|---|---|
| 2,074,821 | A | 3/1937 | Wissmann |
| 2,166,439 | A | 7/1939 | Johnson |
| 2,270,455 | A | 1/1942 | Lichter |
| 2,279,164 | A | 4/1942 | Gettleman |
| 2,805,816 | A | 9/1957 | Morgan |
| 2,835,434 | A | 5/1958 | Watson |
| 3,061,173 | A | 10/1962 | Sawdon |
| 3,164,317 | A | 1/1965 | Bogen |
| 3,813,028 | A | 5/1974 | Greason |
| 3,937,492 | A | 2/1976 | Biron |
| 3,968,927 | A | 7/1976 | Katz et al. |
| 3,986,662 | A | 10/1976 | Luftig |
| 4,368,903 | A | 1/1983 | Jones |
| 4,418,865 | A | 12/1983 | Bowen |
| 4,429,827 | A | 2/1984 | Murray |
| 4,682,793 | A | 7/1987 | Walz |
| 4,809,905 | A | 3/1989 | Goodman |
| 4,915,287 | A | 4/1990 | Volk et al. |
| 4,983,438 | A | 1/1991 | Jameson |
| 5,039,652 | A | 8/1991 | Doll et al. |
| 5,183,203 | A | 2/1993 | Sanders |
| 5,190,210 | A | 3/1993 | Walz |
| 5,267,898 | A | 12/1993 | Doll et al. |

(List continued on next page.)

FOREIGN PATENT DOCUMENTS

| | | |
|---|---|---|
| CA | 263010 | 10/1976 |

*Primary Examiner*—Willmon Fridie, Jr.
(74) *Attorney, Agent, or Firm*—Patents & TMS, P.C.

(57) ABSTRACT

A form is provided for attaching portions thereof to a mailpiece for shipping of the mailpiece by a special service. The form consists of two special service designation sections. The sender may desire to send an article by one of the two special services. The form provides a choice for the sender with regard to the type of special service desired. Detachable parts are provided on a sheet for subsequent attachment to the mailpiece or shipping item following printing thereof. The form includes a number of adhesively backed label sections and a return postcard section for selective attachment to selected areas of a mailpiece or shipping item to identify the mailpiece or shipping item and simplify the task of designating special services for a particular mailpiece or shipping item. The form is designed so that information unique to the mailpiece, such as the identification of the sender and addressee and special handling requests, can be printed on one side of the form only. In addition, the form may be specifically configured so that two such forms may be affixed to a single 8½"×11" sheet.

20 Claims, 21 Drawing Sheets

U.S. PATENT DOCUMENTS 5,288,014 A 2/1994 Meyers et al.
5,316,208 A 5/1994 Petkovsek
5,326,286 A 7/1994 Bixler et al.
5,383,686 A 1/1995 Laurash
5,397,052 A * 3/1995 Walz ..... 229/300
5,413,383 A 5/1995 Laurash et al.
5,486,021 A 1/1996 Laurash
5,501,393 A 3/1996 Walz
5,507,526 A 4/1996 Petkovsek
5,547,227 A 8/1996 Laurash et al.
5,573,277 A 11/1996 Petkovsek
5,626,370 A * 5/1997 Petkovsek ..... 283/116
5,697,648 A * 12/1997 Petkovsek ..... 283/61
5,836,622 A 11/1998 Fabel
6,089,613 A * 7/2000 Petkovsek ..... 283/79

* cited by examiner

LABEL AND/OR FORM FOR SPECIAL SERVICE MAILING AND A METHOD OF ASSEMBLING A MAILPIECE REQUIRING SPECIAL MAILING SERVICES

This application is a continuation-in-part of co-pending U.S. Application Ser. No. 09/413,400, filed Oct. 6, 1999 which is a continuation-in-part of U.S. patent application Ser. No. 08/923,147, filed on Sept. 4, 1997, now abandoned which is a continuation-in-part application of co-pending U.S. patent application Ser. No. 08/714,679 filed on Sept. 16, 1996, which is a continuation-in-part of U.S. patent application Ser. No. 08/281,634 filed on Jul. 28, 1994, issued as U.S. Pat. No. 5,573,277 on Nov. 12, 1996.

BACKGROUND OF THE INVENTION

The present invention generally relates to a form for printing address information relating to mail handling for attachment to a mailpiece. More specifically, the present invention relates to a multi-part form for special service handling of mailpieces or for mailpieces requiring special services.

It is, of course, known to provide specialized postal processing and handling of particular mailpieces. Such special services include the preparation of certified mail, registered mail, insured mail, recorded delivery mail, return receipt for merchandise mail, C.O.D. and the like. The known procedure requires printing or writing of information on various slips of paper and attaching the slips to the outside of an envelope or other mailpiece. Often carbon paper is used to assist in making the attachments.

As an example, to prepare a certified mailpiece, the forms are supplied by the United States Postal Service to the customer. The customer must separately address and complete a certified mailing receipt, both faces of a return receipt card, an envelope or mailpiece in which the mail is to be mailed, and a request for return service on the face of the envelope. Then, the customer or the Postal Service must affix each of the completed parts to the envelope using glue, an adhesive, tape or the like.

In U.S. Pat. No. 4,682,793 to Walz, a multiple-part mailer form assembly is shown in which the addressing of specialized postal handling may be accomplished by continuously fed impact-type printers. The parts are then separated from each other for affixing some parts to the outside to a standard window envelope which can be addressed by the insertion of one of the extra form layers.

This type of multiple-layer continuous assembly cannot be addressed or overprinted in the non-impact printers as commonly used or on less expensive impact-type printers having no means to adjust for strength of impact or thickness of multiple-layer forms. Furthermore, the address information printed on the intermediate or rear layers of such forms is often degraded or blurred to a less readable condition by the necessity of printing through the multiple layers. The degradation renders the use of bar codes unfeasible on the lower layers of the address inserts to be compatible with U.S. Postal Service sorting equipment which is now generally used. Further, the degradation renders unfeasible the use of high-density bar codes in other forms for automated identification of the return receipt postal card when returned to the sender as proof of delivery to the addressee.

Still further, the multiple-part mailer disclosed by Walz requires forms to be separately affixed to the outside of the envelope or other mailpiece by using glue, adhesive, tape, or the like. The form includes a significant amount of carrier, backing, carbon layer, peel-off or other materials which require handling and removal during use and subsequent discarding as waste after use. Further, chemical treatment of some of the layers of the form is also required during manufacturing of the form.

Still further, the mailer disclosed by Walz is not suitable for feeding through automatic non-impact printers and, therefore, the return address of the sender must be printed on the back of the return receipt card portion of the form by non-impact means, i.e. either hand-printing or labeling or offset printing during the manufacturing process. This avoids unwanted reverse printing on the face of the other layers. Also, the mailer of Walz does not disclose a means for noting the request for return receipt service, if desired, on the face of the envelope as required by postal regulations.

Further, the mailer disclosed by Walz does not provide a choice between special services on one form such that a user may decide to use one special service or another and thereby modify the form to effect delivery of a mailpiece by the special service desired.

Clearly, the current methods known for preparing mailpieces or shipping items for special services is tedious, complicated, and labor intensive, particularly for businesses and institutions in which items such as notifications, reminders, or valuable documents are commonly sent by specialized mail services. In many instances, the delivery of such mailpieces must be documented by recording of a U.S. Postal Service or other services return receipt when it arrives back to the sender. This task is also time consuming and has great potential for error when all of the identifying information from each return receipt card must be entered or recorded by hand.

A need, therefore, exists for an improved form for special service mail and shipping handling and a method for assembling a mailpiece or shipping item requiring special services.

SUMMARY OF THE INVENTION

The present invention provides a mailing assembly for shipping and handling an article requiring delivery by a special service. Further, the present invention provides a method for preparing an article for mailing or shipping by a special service.

To this end, in an embodiment of the present invention, a mailing assembly for shipping and handling an article requiring delivery by a special service is provided. The mailing assembly has a return postcard that has a first designator section indicative of a first special service. A second designator section is provided and adjacent the return postcard wherein the second adjacent section is indicative of a second special service.

In an embodiment, an anchor portion is adjacent the return postcard and removably attached thereto.

In an embodiment, a tear line is disposed between the return postcard and the anchor portion.

In an embodiment, the anchor portion has a backside and further wherein a backing layer is disposed on the backside of the anchor portion.

In an embodiment, the anchor portion has a backside and an adhesive is disposed on the backside of the anchor portion.

In an embodiment, an auxiliary label is laterally disposed from the return postcard.

In an embodiment, the second designator section is on a back side of the assembly.

In an embodiment, the first designator section identified certified mail and the second designator section identifies registered mail In another embodiment of the present invention, a method is provided for preparing an article for delivery by a special service. The method comprises the steps of: providing a mailing assembly having a first return postcard section wherein the first return postcard includes a first designator section indicative of a first special service; providing a second designator section indicative of a second special service on the mailing assembly wherein the first special service is distinct from the second special service; providing an anchor portion removably attached to the return postcard wherein the anchor portion has a backing layer disposed on a backside of the anchor portion; and printing information on the first return postcard for delivery of the article by a special service.

In an embodiment, the backing layer is removed from the anchor portion and the first return postcard and anchor portion are adhesively affixed to the article.

In an embodiment, the second designator section is adhesively affixed to the first return postcard directly over the first designator section.

In an embodiment, an auxiliary label having a backing layer is provided. The auxiliary label is laterally disposed from the return postcard.

In an embodiment, the auxiliary label is affixed to the article.

In an embodiment, the auxiliary label is affixed to the return postcard.

In an embodiment, the auxiliary label is configured as a mailing receipt.

In an embodiment, tear lines positioned between adjoining edges of the first return postcard section and the anchor portion are provided. The return postcard is detached from the anchor portion.

In an embodiment, a second return postcard is provided having a third designator section on the assembly and further wherein the second return postcard has a second anchor portion removably attached thereto. A fourth designator section associated with the second return postcard is provided and information is printed on the second return postcard.

In another embodiment of the present invention, an assembly is provided for preparing an article for delivery by a special service. The assembly has a multilayer sheet wherein the sheet includes a first return postcard and a second return postcard wherein the first return postcard has a first designator section thereon wherein the first designator section is indicative of a first special service wherein the first return postcard has a second designator section associated therewith and further wherein the second designator section is indicative of a second special service wherein the second return postcard has a third designator thereon and further wherein the third designator is indicative of the first special service and further wherein the second postcard section has a fourth designator section associated therewith wherein the fourth designator is indicative of the second special service.

In an embodiment, a first anchor portion and a second anchor portion are removably attached to the first return postcard and a second postcard, respectively.

In an embodiment, the first special service identifies certified mail and the second special service identifies registered mail.

It is, therefore, an advantage of the present invention to provide a label/form and a method for simplified assembly of a mailpiece or shipping item requiring special services.

Another advantage of the present invention is to provide a label/form and a method for identifying the type of special service by removal of a portion of the label/form from a sheet and subsequent attachment to a mailpiece or shipping item.

Yet another advantage of the present invention is to provide a label/form and a method for assembly of a mailpiece or shipping item requiring special services such that the label/form and the method can be quickly performed. A still further advantage of the present invention is to provide a label/form and a method for assembling a mailpiece or shipping item using the label/form without requiring additional means for securing the label/form to the mailpiece or shipping item.

Another advantage of the present invention is to provide a label/form that simplifies identification of particular sections thereof for both machine readability and visible identification.

Yet another advantage of the present invention is to provide a label/form for use on mailpieces or shipping items requiring special services that includes printing unique to the mailpiece or shipping item on only one side of the label/form.

And, another advantage of the present invention is to provide a label/form for use on mailpieces or shipping items requiring special services which is sized to occupy only one-half of an 8½ inch backing sheet wherein two such label/forms may be affixed to a single backing sheet.

A further advantage of the present invention is to provide a label/form for use on mailpieces or shipping items requiring special services which is sized so as to fit on a single side of a standard 4⅛ inch by 9½ inch envelope for mailing purposes.

Yet another advantage of the present invention is to provide a mailing assembly and a method of preparing an article requiring delivery by a special service such that a user may choose between two special services and use the same form for either.

A still further advantage of the present invention is to provide a mailing assembly and a method for preparing an article for delivery by a special service wherein forms are provided on an 8½"×11" sheet to be easily fed through a printer.

Another advantage of the present invention is to provide a mailing assembly and a method for preparing an article requiring special services having auxiliary labels to aid in the delivery of the article by the special service.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
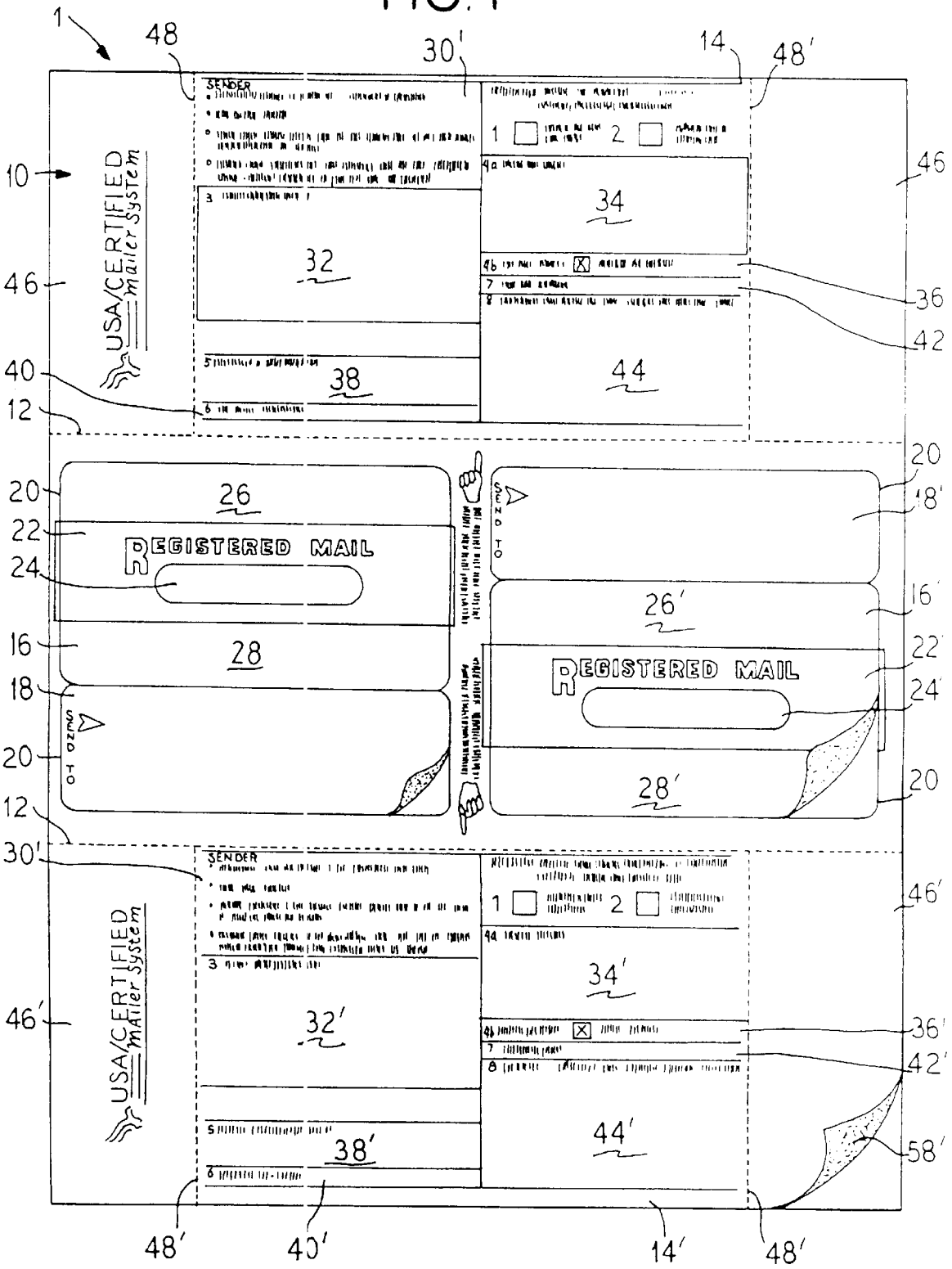
FIG. 1 illustrates a plan view of an embodiment of one side of a label/form for special service mailing/shipping of a mailpiece or shipping item.

Referring now to the drawings, wherein like numerals refer to like parts, a special service mailing label/form is generally illustrated at 1. The label/form 1 consists of a plurality of detachable parts. Some of the parts of the label/form 1 are detachable by tear lines, while other portions of the label/form 1 are attached to the sheet by an adhesive on the back of the portion.

FIG. 1 illustrates a first side 1 of the label form 1. The first side 10 has two sets of detachable parts for satisfying requirements for mailing/shipping of at least one mailpiece or shipping item requiring special services. It should be understood, however, that a particular label/form may be infinite in length satisfying the requirements for any number of mailpieces or shipping items requiring special services. In the alternative, the label/form may be designed such that it satisfies requirements for labeling and special services for a single mailpiece or shipping item. Still further, the label/form illustrated is for registered mail, however, any type of special service mailing or shipping may be satisfied with the present invention, including, but not limited to, registered mail, insured mail, recorded delivery, return receipt for merchandise, C.O.D., etc.

The label/form 1 illustrated in FIG. 1 has the two horizontal perforated tear lines 12 for removal of return receipt card sections 14 and 14' from the remainder of the label/form 1. A second set of parts are adhesively backed to the label/form 1 for removable attachment to the label/form 1 and subsequent attachment to the mailpiece or shipping item. Service identifier sections 16 and 16' are attached to the label/form 1 by an adhesive backing. Sender identifier sections 18 and 18' are similarly adhesively-backed to the label/form 1. The service identifier sections 16 and 16' and the sender identifier sections 18 and 18' have score lines 20 generally defining each of the sections and for simplified removal of the sections 16, 16', 18 and 18' from the label/form 1.

The service identifier sections 16 and 16' include a first special service identifier 22 and 22', respectively. The special service identifiers 22, 22' may be distinctly colored from the remainder of the service identifier sections 16, 16'. Still further, letters may be imprinted on the service identifier sections 16, 16' indicating the particular type of special service, such as the "REGISTERED MAIL" identifier.

Contrasting colored sections 24, 24' are provided within the special service identifiers 22, 22' of the service identifier sections 16, 16'. The contrasting colored sections 24, 24' may be printed with an identifier such as an article number and/or may be further printed with variable specific instructions as "RETURN RECEIPT REQUESTED" or other imprinting as desired.

Figure 4:
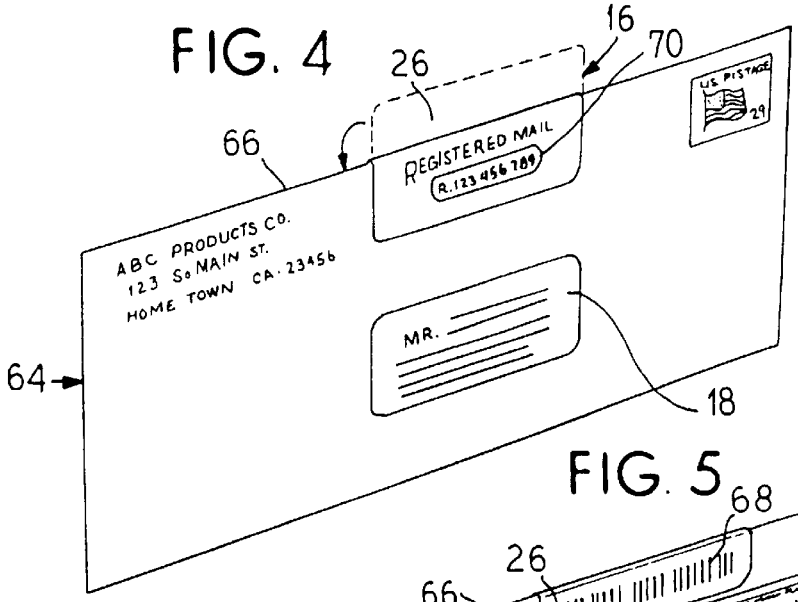
FIG. 4 illustrates a perspective view of an embodiment of one side of a mailpiece or shipping item with attachment of a portion of the label/form required for special service mail or shipment handling of the mailpiece or shipping item.

Top sections 26, 26' and bottom sections 28, 28' are provided on opposite sides of the special service identifiers 22, 22' for additional space for printing in label/formation as desired or, alternatively, may be left unprinted or blank. The top sections 26, 26' are particularly suitable for printing of bar codes, OCR type or other machine-readable images. The top sections 26, 26' are inverted when sealed onto the mailpiece or shipping item (as illustrated in FIG. 4) such that a back side of the mailpiece or shipping item includes the identifier associated with the mailpiece or shipping item.

The return receipt card sections 14, 14' on the first side 10 of the label/form 1 are removably attached to the label/form 1 by the perforated tear lines 12. The return receipt card sections 14, 14' include instruction sections 30, 30', article addressee sections 32, 32', article number or identifier sections 34, 34', service type sections 36, 36', addressee signature sections 38, 38', and agent signature sections 40, 40'. Further, date of delivery sections 42, 42' and addressee's address sections 44, 44' are provided. This particular label/form is suitable for a return receipt card for registered mail and other special service mail and shipping items. Of course, similar type receipt cards capable of providing a return receipt following delivery of the mailpiece or shipping item may be implemented.

Any one or more of the aforementioned sections may be of contrasting color to the main background color of the remainder of the label/form 1. For instance, typically, the background color of the return receipt card sections 14, 14' may be a green shade commonly used for return receipt cards. The identifier sections 34, 34' may have a white background for simplified reading of, for example, a bar code or OCR characters printed thereon. Likewise, the article addressee sections 32, 32' may be printer with a white background for immediate recognition on the label/form 1 of the delivery point of the mailpiece or shipping item carrying the label/form 1. The central portion of the label/form 1 including the service identifier sections 16, 16' and the sender identifier sections 18, 18' may be similarly shaded with contrasting colors for identification and machine readability purposes of the bar codes and/or OCR characters or the like.

Figure 5:
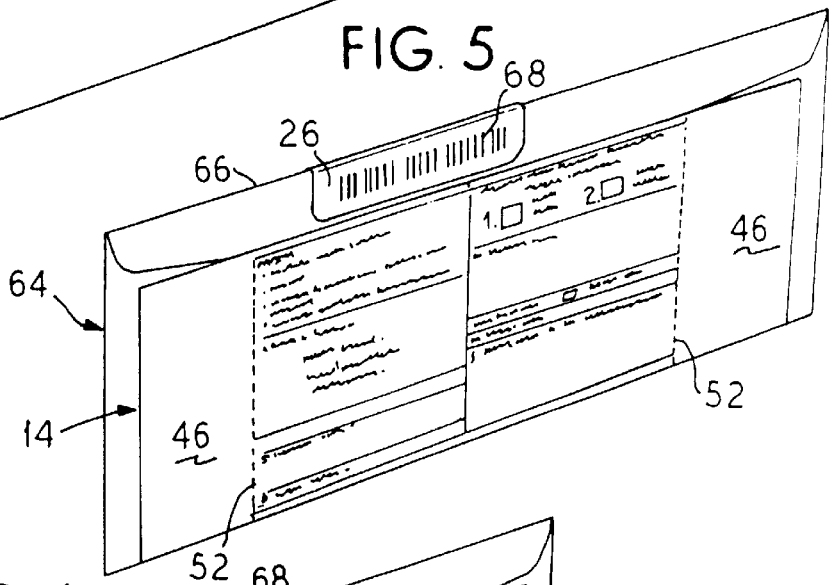
FIG. 5 illustrates a plan view of an embodiment of a second side of a mailpiece or shipping item with a second portion of the label/form required for special service handling of the mailpiece or shipment attached to the mailpiece or shipping item.

Peelable sections 46 and 46' are provided a silicon layer 56' and an adhesive layer 58' for removably detaching the back side of the label/form 1 from the return receipt card and subsequent attachment to the mailpiece or shipping item as illustrated in FIG. 5. To this end, that portion of the return receipt card sections 14, 14' on the fist side 10 of the label/form 1 is attached in its entirety to the mailpiece or shipping item. Vertical perforated lines 52, 52' are provided for subsequent detachment of the return receipt card from the mailpiece or shipping item (as illustrated in FIG. 6).

Figure 2:
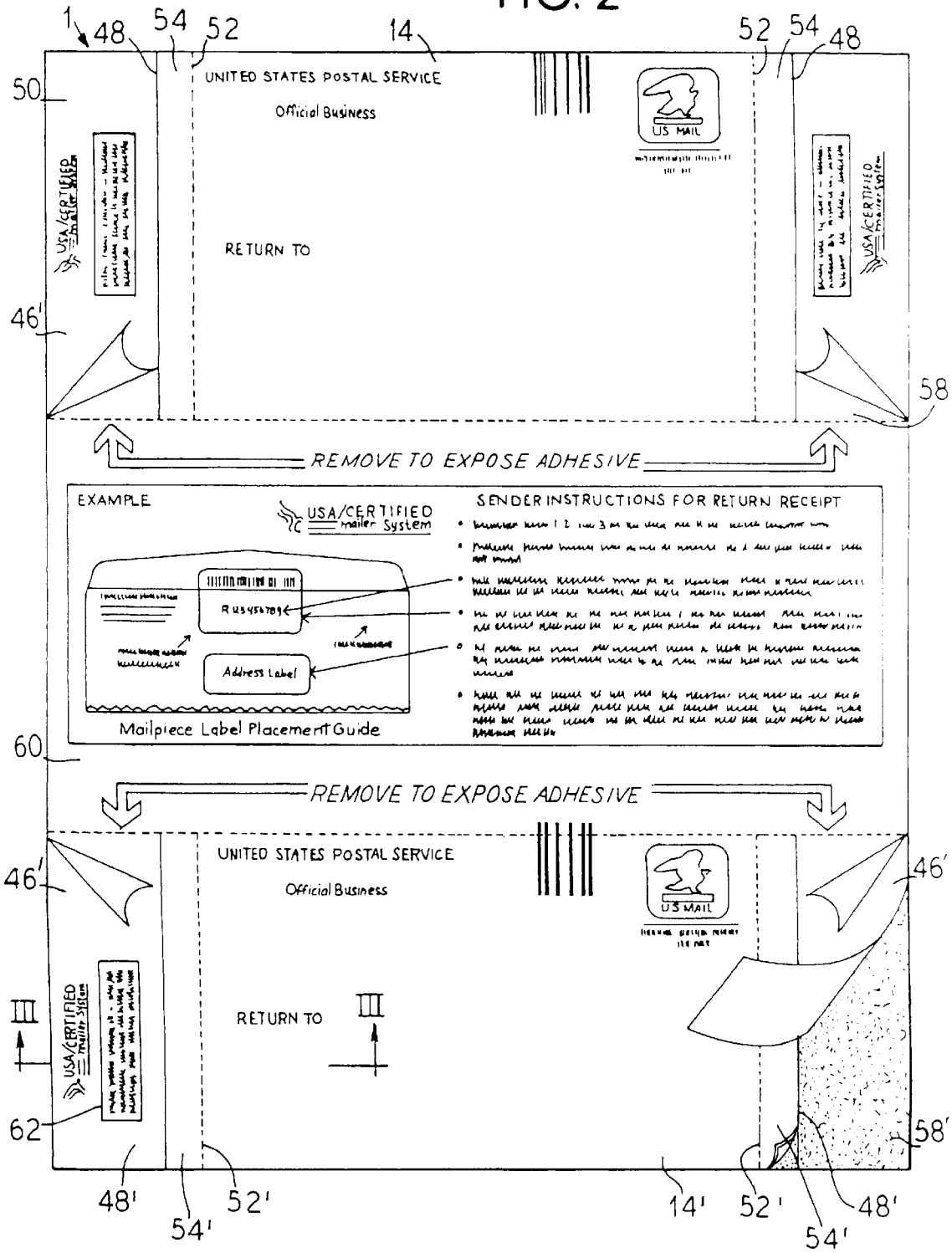
FIG. 2 illustrates a plan view of an embodiment of a second side of a label/form for special service mailing/shipping of a mailpiece or shipping item.
Figure 3:
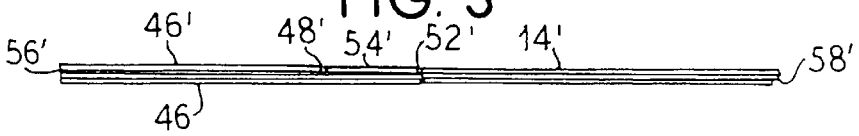
FIG. 3 illustrates a partial cross-sectional view taken generally along the line III—III of FIG. 2.

Referring now to FIG. 2, a back side 50 of the label/form 1 is illustrated. The back side 50 includes front faces of the return receipt card sections 14, 14'. The vertical perforated tear lines 52, 52' are further provided inside of vertical slit lines 48, 48'. The area between the vertical slit lines 48, 48' and the vertical perforated tear lines 52, 52' define typing together sections 54, 54'. The tying together sections 54, 54' include an area having a back having a partial section thereof containing the adhesive layer 58, 58' as illustrated in FIGS. 2 and 3. That is, the adhesive layer 58, 58' from the peelable sections 46, 46' continues into the tying together sections 54, 54' for securing the return receipt card sections 14, 14' thereto.

The adhesive layers 58, 58' are provided to prevent separation of the layers of the return receipt card label/forming the front side and the back side thereof. A central section 60 is provided on the back side 50 including instructions for assembling the label/form onto the mailpiece or shipping item. Additional instructions may be provided on the peelable sections 46, 46' as generally illustrated at 62.

Figure 6:
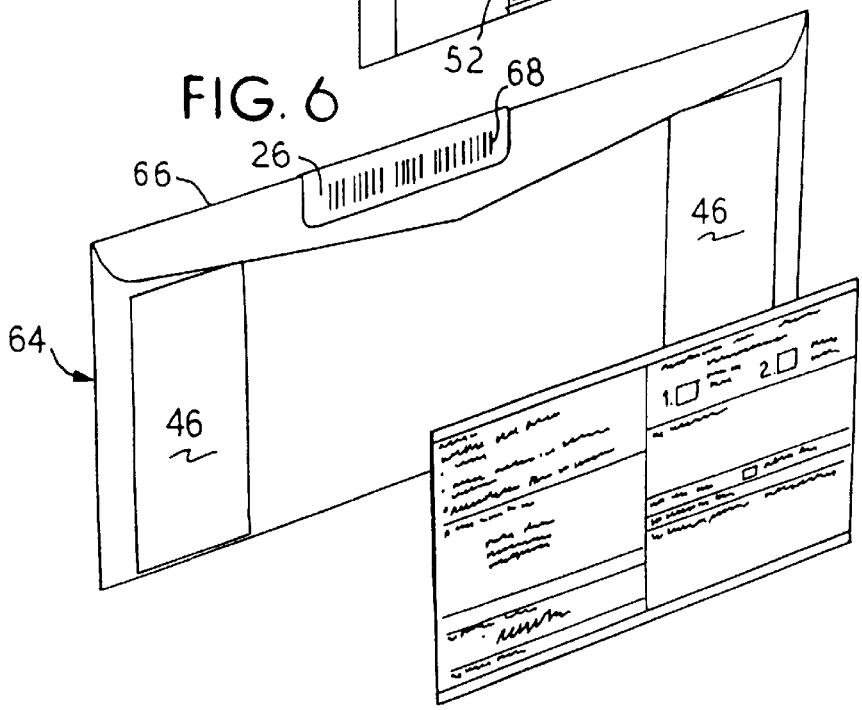
FIG. 6 illustrates a perspective view of an embodiment of a second side of the mailpiece or shipping item with a portion of the second part of the label/form detached from the mailpiece or shipping item.

The assembling of a mailpiece or shipping item 64 with the respective portions of the label/form 1 is more clearly illustrated in FIGS. 4–6. To assemble the mailpiece or shipping item 64, a sender identifier section 18 is first removed from the first side 10 of the label/form 1 and centered onto the mailpiece or shipping item 64. Then, following printing of the requisite information onto each of the individual sections, the service identifier section 16 is attached at a top edge 66 of the mailpiece or shipping item 64. The section of the service identifier section 17 referred to as the top section 26 is inverted to face on the back side of the mailpiece or shipping item 64 as illustrated in FIGS. 5 and 6. The top section 26 may include a machine readable identifier 68 corresponding to the numerical identifier 70 on a front side of the mailpiece or shipping item 64. Then, the return receipt card section 14 may be attached to a back side of the mailpiece or shipping item 64 by removing the peelable sections 46 such that the adhesive layer 58,58' on the underside of the sections 46 is placed on the back side of the mailpiece or shipping item 64. As a result, the return receipt card section 14 is attached to the back side of the mailpiece of shipping item 64.

Following delivery of the mailpiece or shipping item 64, the return receipt card of the return receipt card section 14 may be detached along the vertical perforated tear lines 532 separating the return receipt card from the remainder of the mailpiece or shipping item 64. The peelable sections 46 maintain their adhesion to the back side of the mailpiece or shipping item 64 as shown in FIG. 6.

Figure 7:
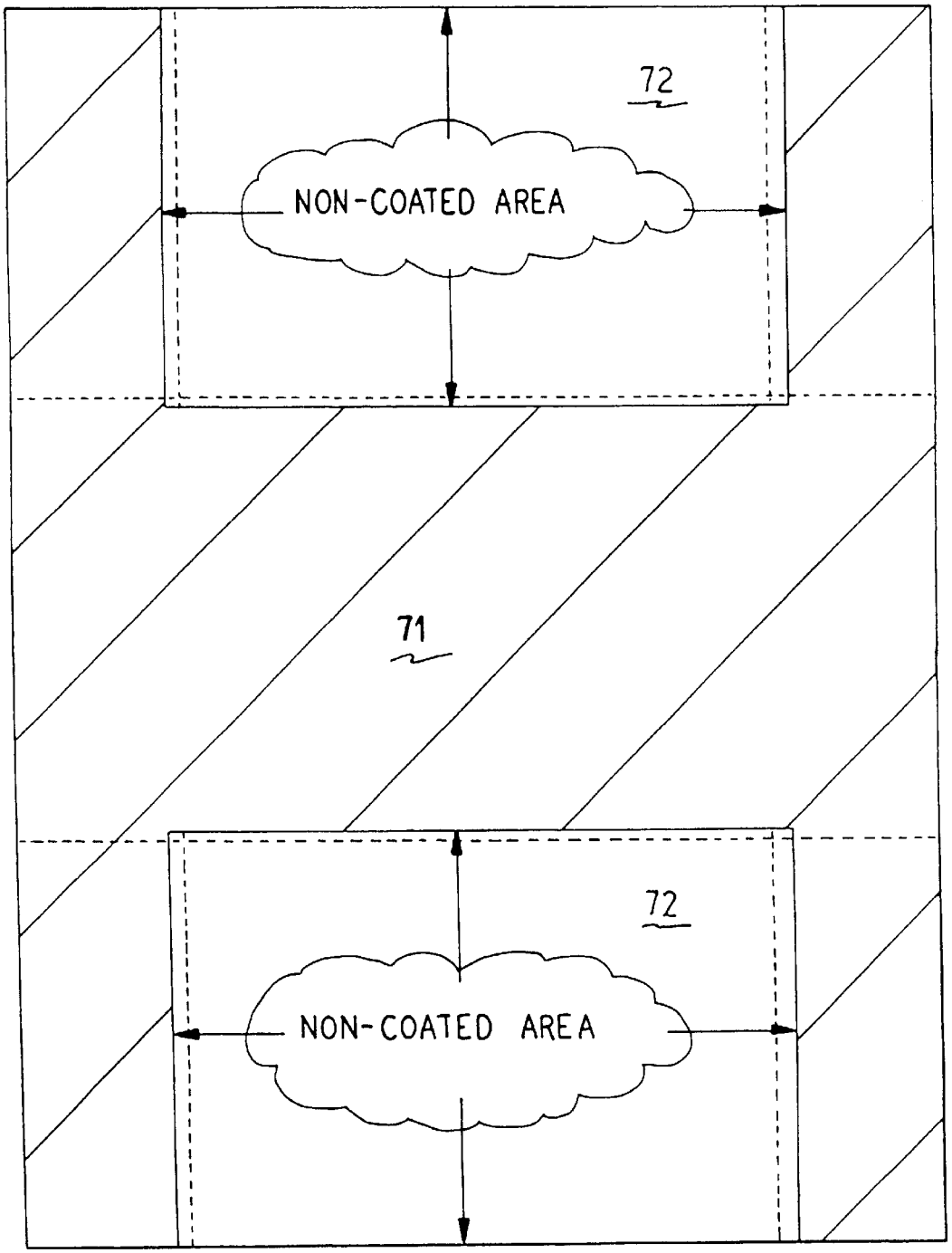
FIG. 7 illustrates a plan view of the label/form of the present invention designating the areas of the label/form having coated and non-coated areas of adhesive.

As illustrated in FIG. 7, the area generally designated at 70 includes the silicone layer 56 or 56' and the adhesive layer 58 or 58', respectively, providing the necessary peelability of layers of the label/form 1. The non-coated areas generally designated at 72 include only the adhesive layer preventing peelability between the layers formed by the front side and the back side of the label/form 1 resulting in formation of the return receipt card 14. The combination of the adhesive layer 58 with the silicone layer 56 also prevents or inhibits migration of the adhesive layer 58 along edges, perforations, and/or slits of the label/form 1.

In yet another alternative embodiment, the label/form 110 consists of a plurality of detachable parts. The parts of the label/form 110 are detachable by tear lines, score lines, perforations or the like.

Figure 8:
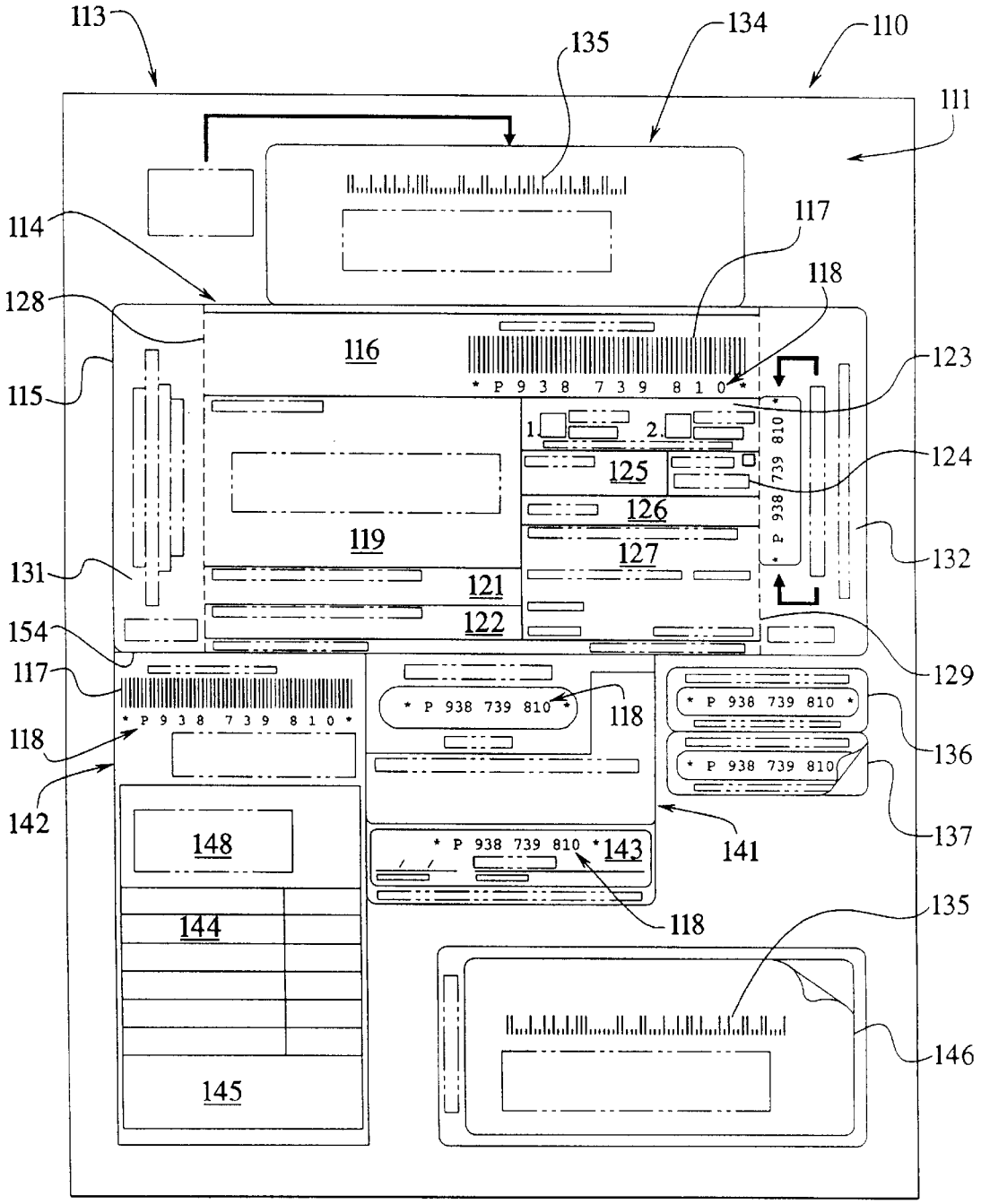
FIG. 8 illustrates a plan view of an embodiment of the front side of a label/form for special service mailing/shipping of a mailpiece or shipping item.
Figure 9:
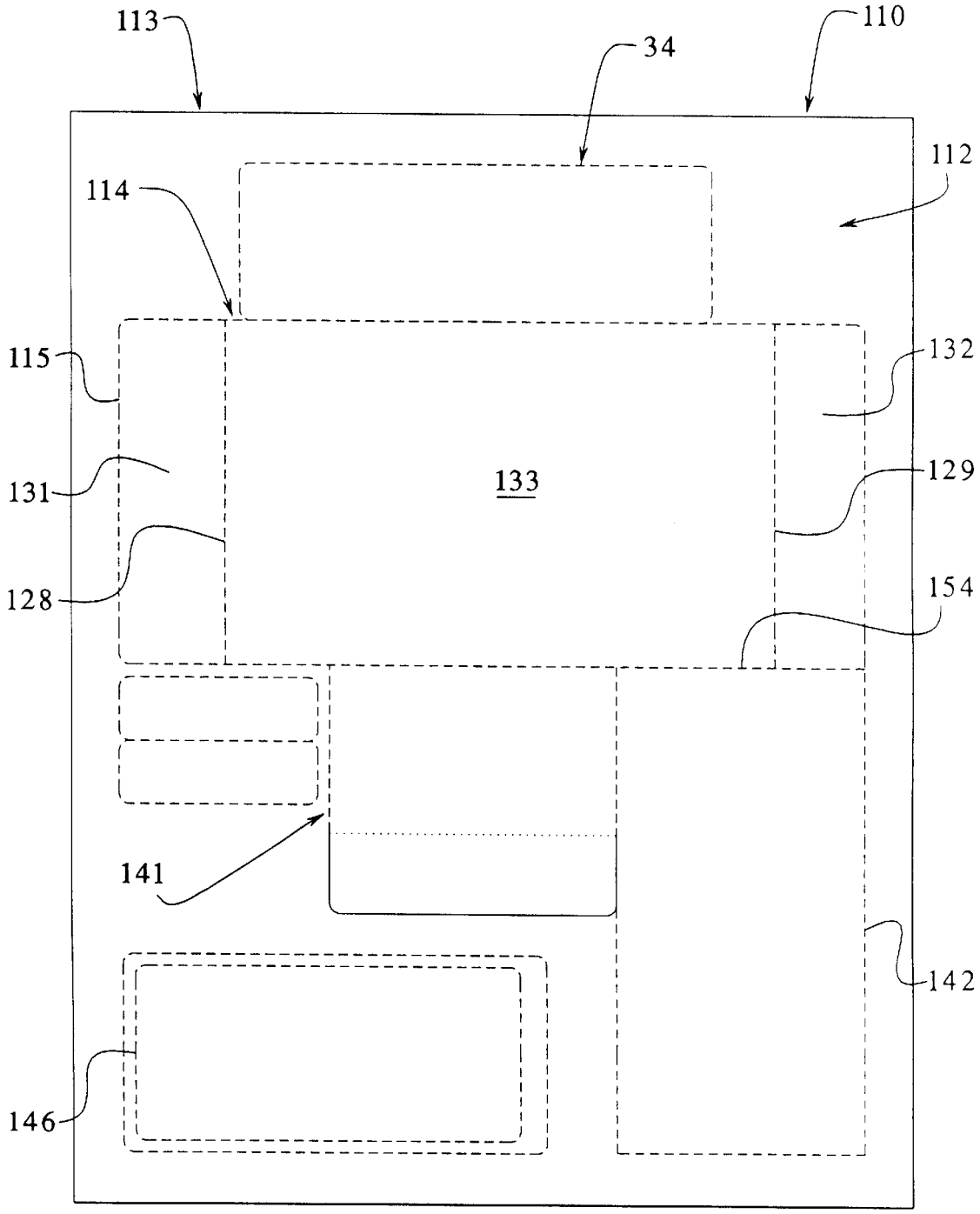
FIG. 9 illustrates a plan view of an embodiment of a back side of a label/form for special service mailing/shipping of a mailpiece or shipping item.

FIG. 8 illustrates a first or a front side 111 of the label/form 110. FIG. 9 illustrates a second or back side 112 of the label/form 110. For purposes of clarity, the side 111 will hereinafter be refereed to as the front side 111, and the side 112 will hereinafter be referred to as the back side 12.

As illustrated in FIG. 8, the front side 111 has one set of detachable parts for satisfying requirements for the mailing/shipping of at least one mailpiece or shipping item requiring special services. It should be understood, however, that a particular label/form may be infinite in length satisfying the requirements for any number of mailpiece or shipping items requiring special services. In the alternative, the label/form may be designed such that it satisfies requirements for labeling and special service a for a single mailpiece or shipping item. Still further, the label/form illustrated is for registered mail; however, any type of special service mailing or shipping may be satisfied with the present invention, including, but not limited to, registered mail, insured mail, recorded delivery, return receipt for merchandise, C.O.D., etc.

The label/form 110 illustrated in FIGS. 8 and 9 comprises a sheet 113 with a plurality of detachable parts that are defined by tear lines, score lines or perforations that extend through the sheet 113, or through the front side 111 to the back side 112 as illustrated in FIGS. 8 and 9. The side of the postcard 114 which is disposed in the front side of the label/form 110 is that which requires the most amount of information specific to the particular article. In order to provide a label/form 110 which requires printing on one side only, such as the front side 111, it is necessary to dispose that side of the postcard 114 which may be printed with the appropriate information relevant to the article being shipped, the sender and the addressee.

Therefore, the postcard 114 includes an article identification section 116 which may include a bar code 117, a number 118 o other suitable means for uniquely identifying the article being shipped. An addressee identification section is provided at 119 on which the name and address of the addressee is pre-printed. A receiver identification section 121 and a receiver signature section 122 are provided to record the name and signature of the person acknowledging receipt of the article.

Additional informational sections are provided to the right of sections 119, 121 and 122 for varying purposes. For example, a special services request section 123 may be provided for requesting special services such as locating the addressee's address or restricting delivery. A service request section 124 may be provided for requesting special services such as certified delivery. An additional article identification section may be provided at 125. A delivery date section may be provided at 126. An address identification request section may be provided at 127 for recording the addressee's address if such a service is provided.

The return postcard 114 includes two perforated score lines 128, 129 which separate the postcard 114 from the two adhesive sections 131,132. The two adhesive sections 131, 132 enable the postcard 114 to be removably attached to the article to be mailed because, as illustrated in FIG. 9, the entire back side 112 of the label/form 110 is coated with adhesive with the exception of the back side 133 of the postcard 114. Thus, the two adhesive sections 131,132 may be affixed to the article to be mailed, and the postcard 114 may be detached from the adhesive sections 131,132 and the article to be mailed by tearing along the tear lines 128,129.

Also illustrated in FIG. 8 is the sender ID section or label 134 which is pre-printed with the sender's address. The label 134 is then folded over and onto the back side 133 of the postcard 114. By providing the sender's address 134 at the front side 111 of the label/form 110, the label 134 may be pre-printed with the other components of the label/form 110 shown in FIG. 8 thereby eliminating any need for pre-printing any component shown on the back side 112 in FIG. 9. Accordingly, all of the information specific to the article being mailed is printed on the front side 111 of the label/form 110 which eliminates the need for any two-sided printing. Accordingly, a preferred embodiment will include a removable backing layer (not shown) which covers the back side 112 of the label/form 110 to protect the adhesive layer.

As illustrated in FIG. 8, the sender address label 134 may also include a bar code 135 or other identification means. Additional article identification labels may be provide at 136,137.

In addition to the sender address label 134 which is preferably attached to the return postcard section 114, a service identification label 141 and a receipt label 142 are also disposed adjacent top, and preferably connected to, the return postcard 114. The service identification label 141 preferably includes a specification of the type of service required (e.g., certified mail) in addition to the article identification number 118 or other article identification means. In addition to the number 118, a bar code may be provided in the label 141. Optionally, a sender identification section may be provided at 143 which again may optionally include the article identification number 118. The receipt label 142 also preferably includes the article identification number 118, the bar code 117 or other suitable identification means. The receipt 142 may also provide an addressee identification section 148, a fee calculation section 144 and a space 145 for indicating the postmark or postage date.

Also illustrated in FIG. 8 is the addressee label section 146. The addressee label section 146 may also include a bar code 135 or other similar identification means.

In a preferred embodiment, the sender address label 134, the return postcard 114 as attached to the adhesive sections 131,132, the service ID label 141 and the receipt label 142 are all detachably connected together as illustrated in FIG. 8. In use, the addressee identification label 146 is removed from the sheet 113 and attached to the front side 153 of the envelope 151. Then, the sender address label 134, the postcard section 114 and adhesive sections 131,132, the service identification label 141 and the receipt label 142 are all pulled off of the sheet 113 as a single piece. The sender address label 134 is then folded over and onto the back side 133 of the postcard 114 as illustrated in FIGS. 9 and 11.

Figure 10:
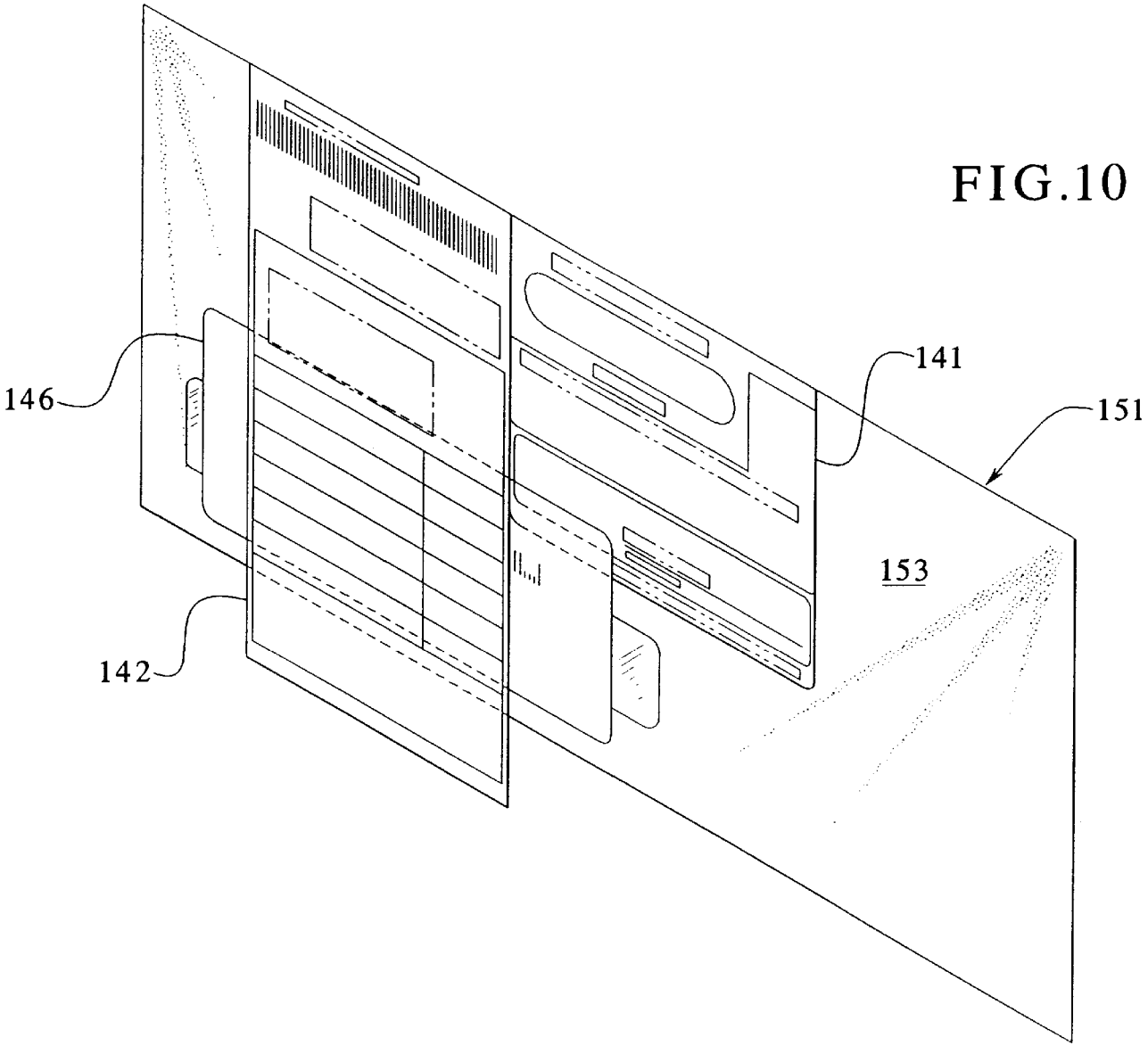
FIG. 10 illustrates a perspective view of an embodiment of a front or address side of a mailpiece or shipping item with attachment of a portion of the label/form required for special service mail or shipment handling of the mailpiece or shipping item.
Figure 11:
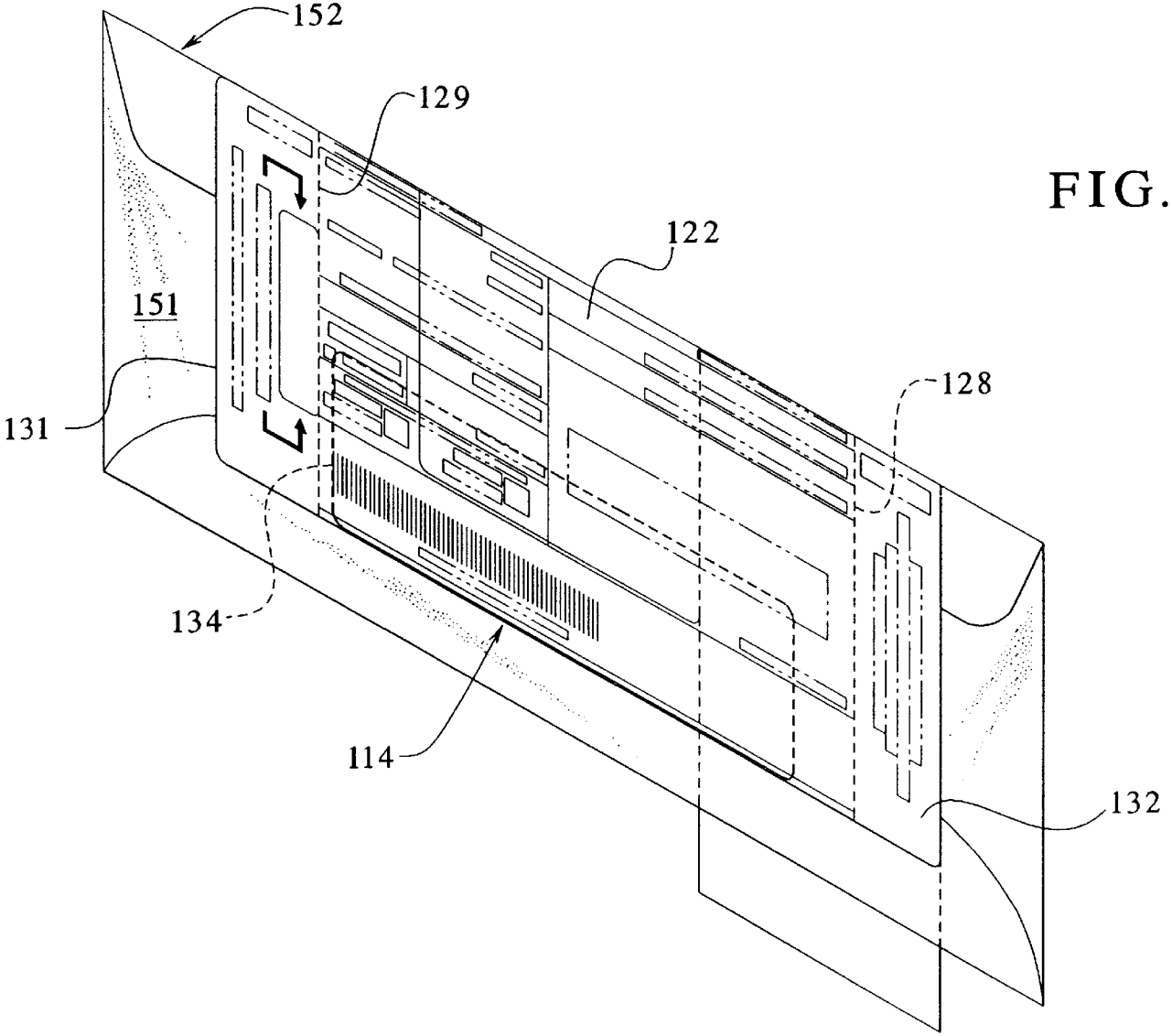
FIG. 11 illustrates a plan view of an embodiment of a back side of a mailpiece or shipping item with a second portion of the label/form required for special service handling of the mailpiece or shipping item.

Still referring to FIG. 11, the return postcard section 114 and the adhesive sections 131,132 are then attached to a back side 151 of the article to be mailed 152 which, as illustrated in FIGS. 10 and 11, may be an envelope. Then, as illustrated in FIG. 10, the receipt label 142 and the service identification label 141 are then folded over and onto the front side 153 of the envelope 151. After the receipt 142 has been filled out and postmarked, it can be easily removed by pulling it off of the envelope 151 and tearing it along the score line shown at 154 in FIGS. 8 and 9.

After the envelope 152 has been shipped to the addressee, and the addressee or a representative has acknowledged receipt by signing in the signature space 122, the postcard 114 can be removed from the envelope 152 by tearing along the perforated lines 128,129. With the sender return address label 134 in place on the back side 133 of the postcard 114 as illustrated in FIGS. 9 and 11, the postcard 114 is then ready to be mailed. It will be noted hat the back side 133 of the postcard 114 should be preprinted with a first-class mail permit number and a return address listing the United States Postal Service as the return addressee.

Figure 12:
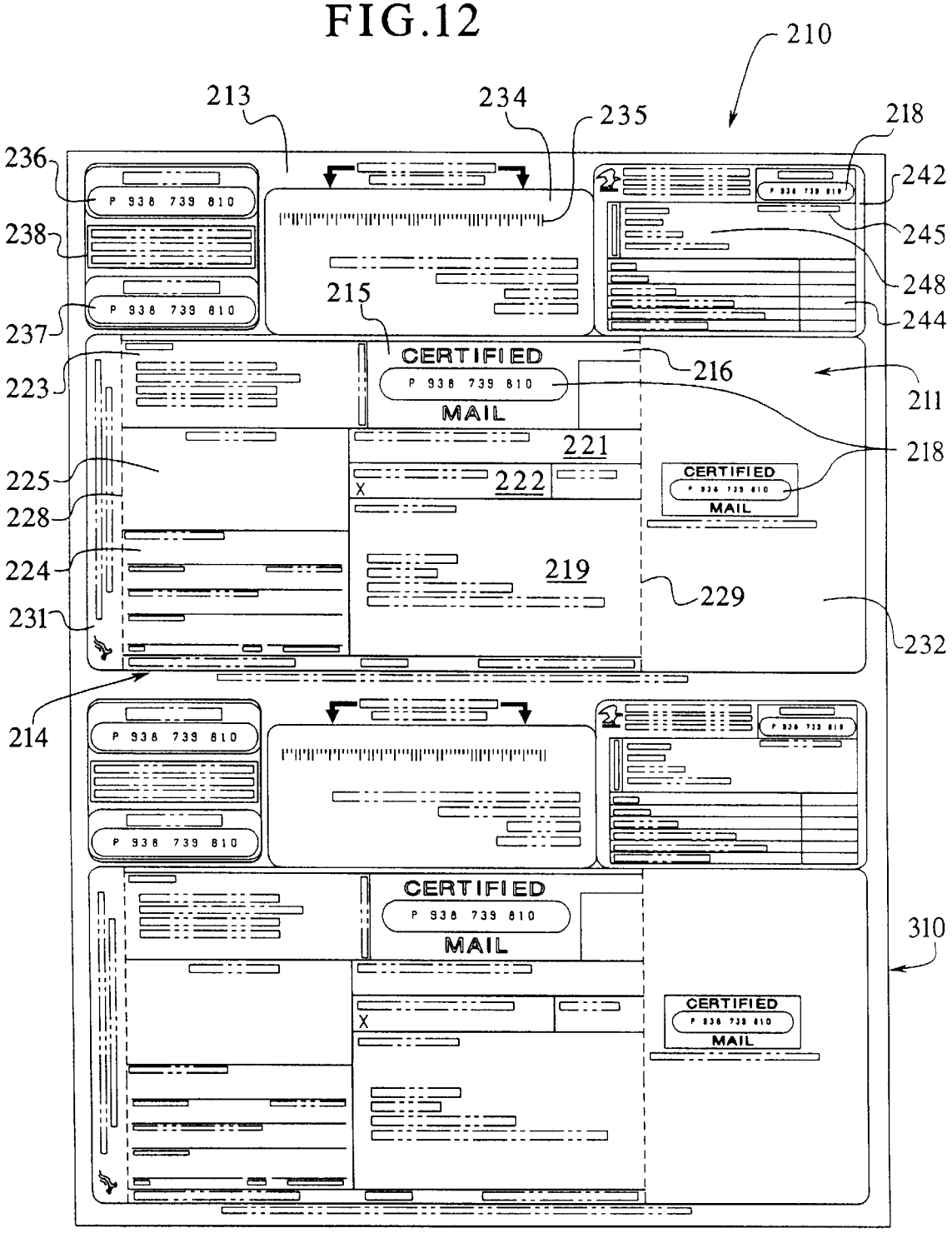
FIG. 12 illustrates a plan view of an embodiment of a front side of two label/forms of the present invention affixed to a single backing sheet.
Figure 13:
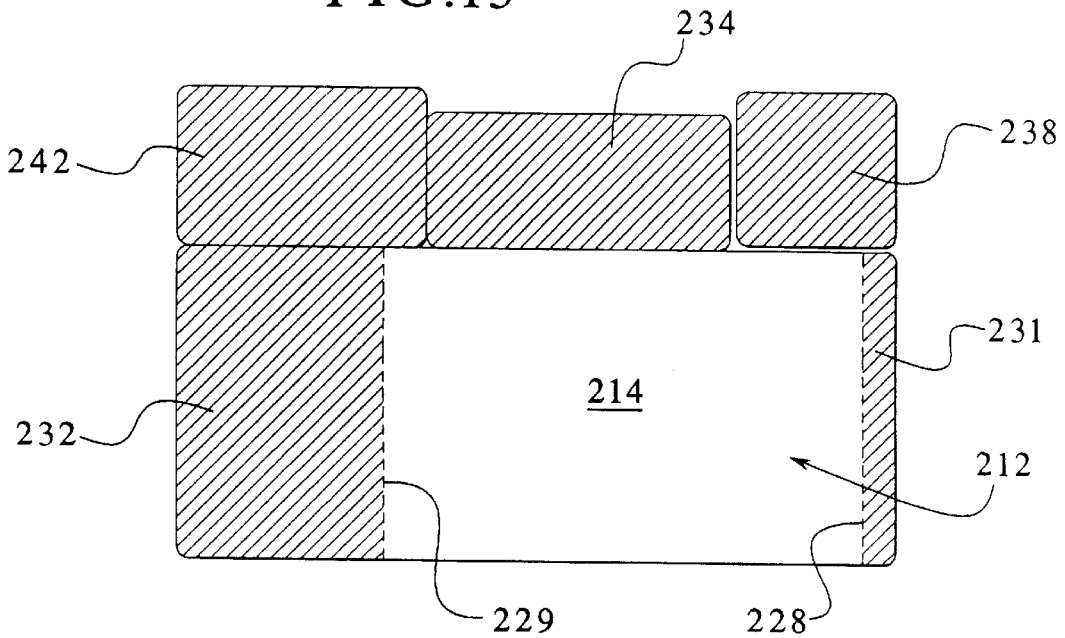
FIG. 13 illustrates a plan view of an embodiment of a back side of a label/form for special service mailing/shipping of a mailpiece or shipping item.

In a further alternative embodiment illustrated in FIGS. 12–17*b*, a label/form 210 consists of a plurality of detachable parts. The parts of the label/form 210 are detachable by tear lines, score lines, perforations or the like. FIG. 12 illustrates a first or a front side 211 of the label/form 210 while FIG. 13 illustrates a second or back side 212 of the label/form 210. It should be noted that the label/form 210 illustrated in FIG. 12 is for certified mail. However, any type of special service mailing or shipping may be satisfied with the present invention, including, but not limited to, registered mail, insured mail, recorded delivery, return receipt for merchandise, C.O.D. etc.

The label/form 210 illustrated in FIGS. 12 and 13 has a backing sheet 213 ad a plurality of detachable parts attached to the backing sheet 213 that are defined by tear lines, score lines, or perforations that extend through the sheet 213 or through the front side 211 to the back side 212. The label/form 210 is sized to occupy only one-half of the space on one side of the backing sheet 213. Accordingly, a second label/form 310 may also be attached to the backing sheet 213. Label/form 310 is identical in both appearance and function to label/form 210 and the following detailed description is applicable to both label/form 210 and label/form 310.

As illustrated in FIG. 12, a return postcard is generally shown at 214. The postcard 214 includes an article identification section 216 which may include an article number 218 or other suitable means for uniquely identifying the article being shipped. An addressee identification section 219 is provided on which the name and address of the addressee is pre-printed. A receiver identification section 221 and a receiver signature section 222 are also provided to record the name and signature of the person acknowledging receipt of the article.

Additional informational sections are also provided on the return postcard 214 since this return postcard 214 also serves as the primary addressee address label for delivery of the article. Accordingly, the return postcard 214 also includes a sender identification section 223 and an addressee address correction section 224. If so desired, an additional article identification section 225 may also be provided.

The return postcard 214 includes two perforated tear lines 228,229 which separate the postcard 214 from the two adhesively-backed anchor sections 231,232. Of course, the perforated tear lines 228,229 may be suitably replaced with score lines or the like which are generally well known to those having ordinary skill in the art. The two anchor sections 231,232 enable the postcard 214 to be removably attached to the article to be mailed because, as illustrated in FIG. 13, the entire back side 212 of the label/form 210 is coated with an adhesive with the exception of the back side of the postcard 214. Thus, the two anchor sections 231,232 may be affixed to the article to be mailed and the postcard 214 may be detached from the anchor sections 231,232 and the article to be mailed by tearing along the two perforated tear lines 228,229.

Also illustrated in FIG. 12 is the return address label 234 that may be pre-printed with the sender's address. After the label/form 210 is removed from its associated backing sheet 213, the label 234 is then folded over and onto the back side 212 of the label/form 210 (specifically, the back side of the postcard 214).

In another embodiment, return address label 234 is folded over and onto the back side of the mailpiece to which the label/form 210 is attached., In yet another embodiment, the return address label 234 is detachable from the label/form 210 and is separately attached to the desired mailpiece. By providing the return address label 234 on the front side 211 of the label/form 210, the label 234 may be simultaneously pre-printed with the other components of the label/form 210 shown in FIG. 12 thereby eliminating any need for pre-printing any components shown on the back side 212 in FIG. 13. Accordingly, all of the information specific to the article being mailed is printed on the front side 211 of the label/form 210 which eliminates the need for any two-sided printing.

As illustrated in FIG. 12, the return address label 234 may also include a bar code 235 or other identification means associated with the article to be mailed. Additional article identification labels 236,237 in article identification section 238 may also be provided.

A receipt label 242 may also be provided on the label/form 210. The receipt label 242 preferably includes the article identification number 218 or other suitable identification means. The receipt label 242 may also include an addressee identification section 248, a fee calculation section 244 and a space 245 for indicating the postmark or postage date.

Figure 14:
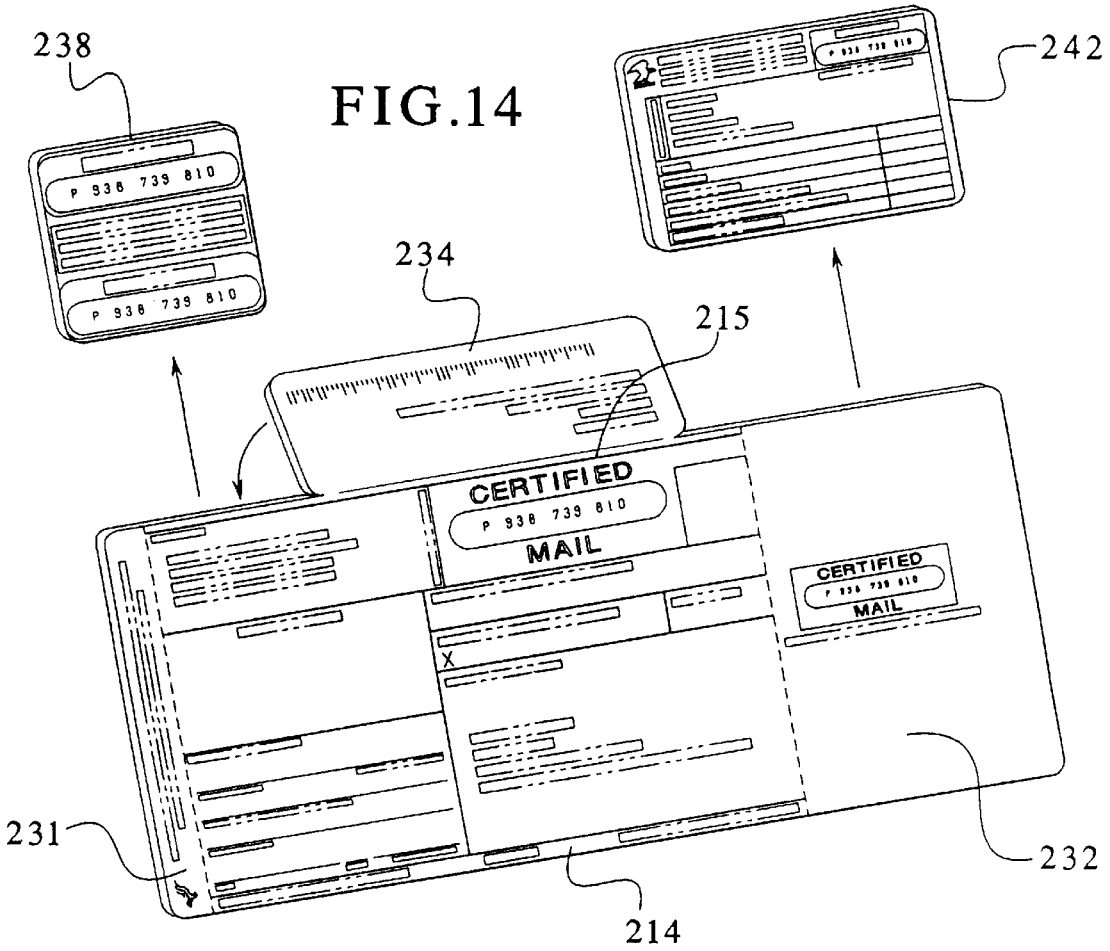
FIG. 14 illustrates a perspective view of an embodiment of a front side of the label/form required for special service mailing or shipping of the mailpiece or shipping item with label sections removed and with a return address section being folded back upon a back side of the label/form.

In a preferred embodiment, the return postcard, the return postcard 214, the anchor sections 231,232, the return address label 234, the article identification section 238 and the receipt label 242 may all be detachably connected together as illustrated in FIG. 12. In use, and as shown in FIG. 14, the article identification section 238 is removed from the backing sheet 213 and the remainder of the label form 210 wherein the article identification section 238 may be used by the sender of the article for various article identification record-keeping purposes. Then, the receipt label 242 may be detached from the remainder of the label/form 210, along with its associated portion of the backing sheet 213, wherein the receipt label 242 may be retained by the sender of the article as a mailing receipt. Next, the combination of the return postcard 214, anchor sections 231,232 and the return address label 234 are detached from the backing sheet 213. The return address label 234 may then be folded back along fold line 215 and affixed onto the back side of the postcard 214 as illustrated in FIG. 14, folded back along fold line 214 and affixed onto the back side of the relevant mailpiece, or detached from the remainder of the label/form 210 and separately attached to the mailpiece.

Figure 15:
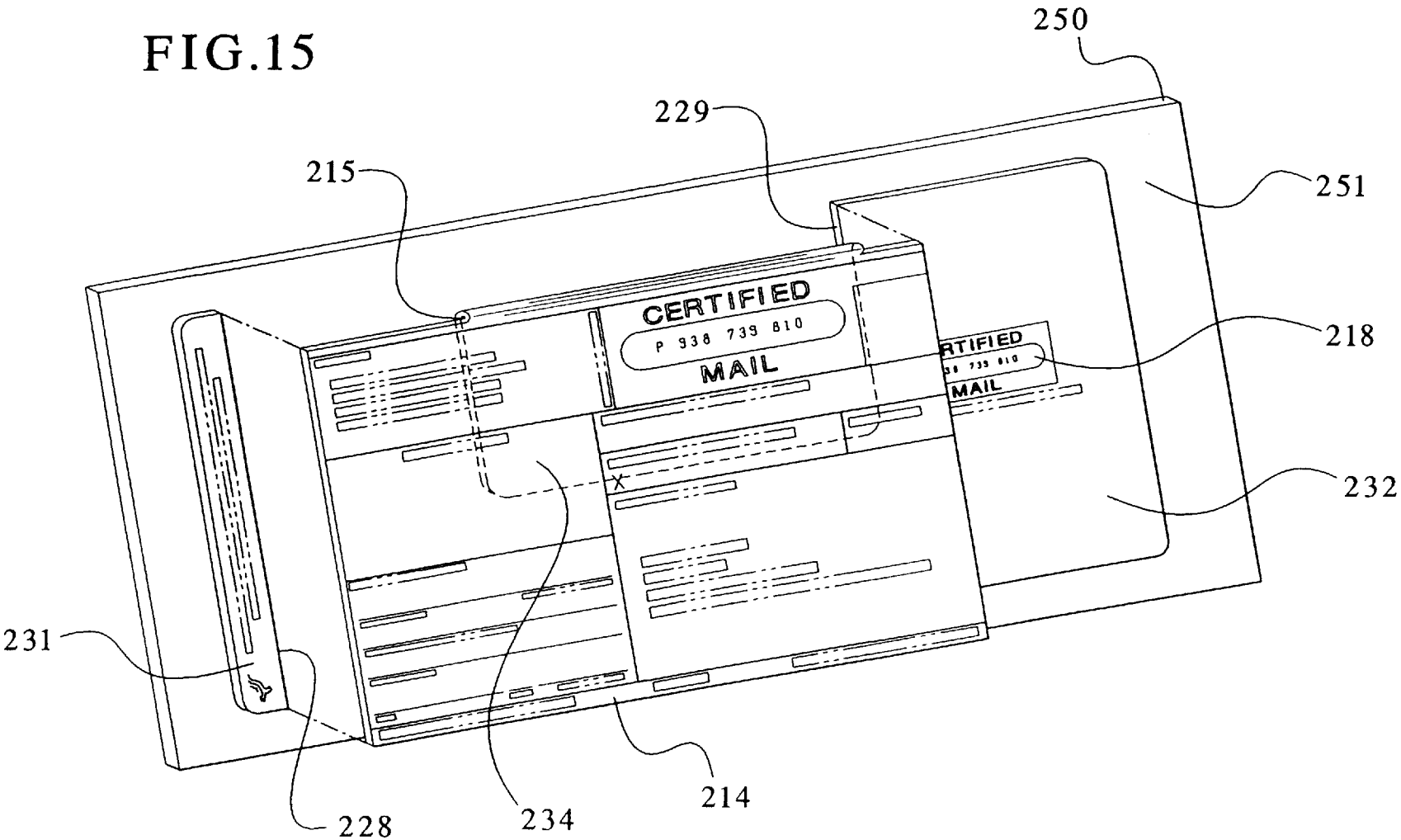
FIG. 15 illustrates a perspective view of an embodiment of a front or address side of a mailpiece or shipping item with attachment of a portion of the label/form required for special service mailing of the mailpiece, a return address section being folded back upon a back side of the label/form and a detachable card section shown detached from the remainder of the label/form.

Referring to FIG. 15, the return postcard 214 and the anchor sections 231,232 are attached to a single side 251 of the article 250 to be mailed. After the article 250 is delivered to the addressee, and the addressee or representative has acknowledged receipt by signing in the signature space 222, the return postcard 214 may be detached from the article 250 by tearing along the perforated tear lines 228,229. With the return address label 234 (hidden from view, shown by dashed lines) in place on the back side of the return postcard 214, the return postcard 214 is ready to be mailed. Of course, the back side of the return postcard 214 may be preprinted with a first-class mail permit number and a return address listing the United States Postal Service as the return addressee.

Figure 16:
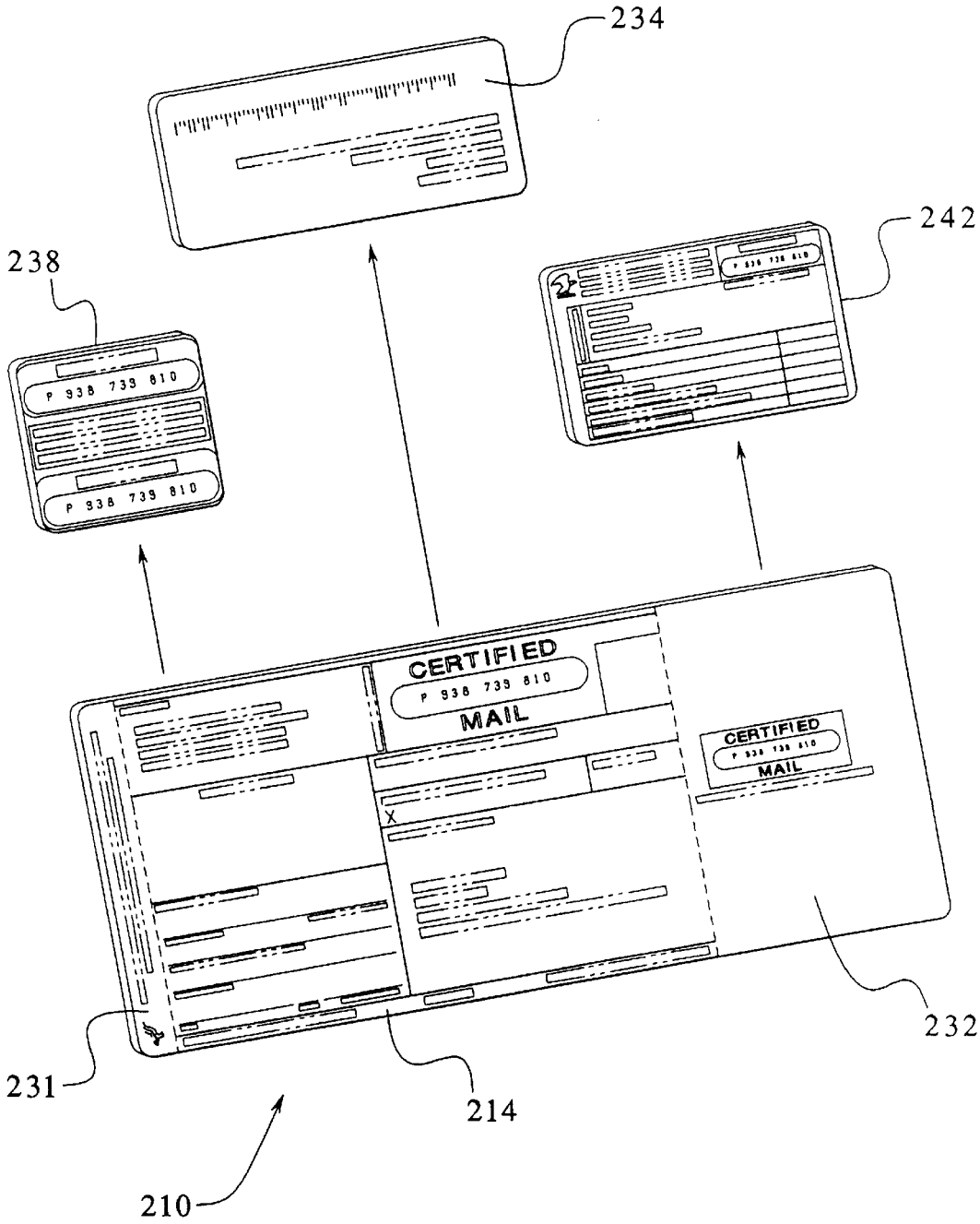
FIG. 16 illustrates a perspective view of an embodiment of a front side of the label/form with both the return address section and the label sections removed.

FIG. 16 shows an alternative embodiment of the label/form 210 of the present invention wherein the return address label 234 may be altogether detached from the remainder of the label/form 210 along with the article identification section 238 and the receipt label 242. With such an embodiment, the return address label 234 may be affixed anywhere on the mailing article as a return address label separate and apart from the remainder of the label/form 210.

Figure 17A:
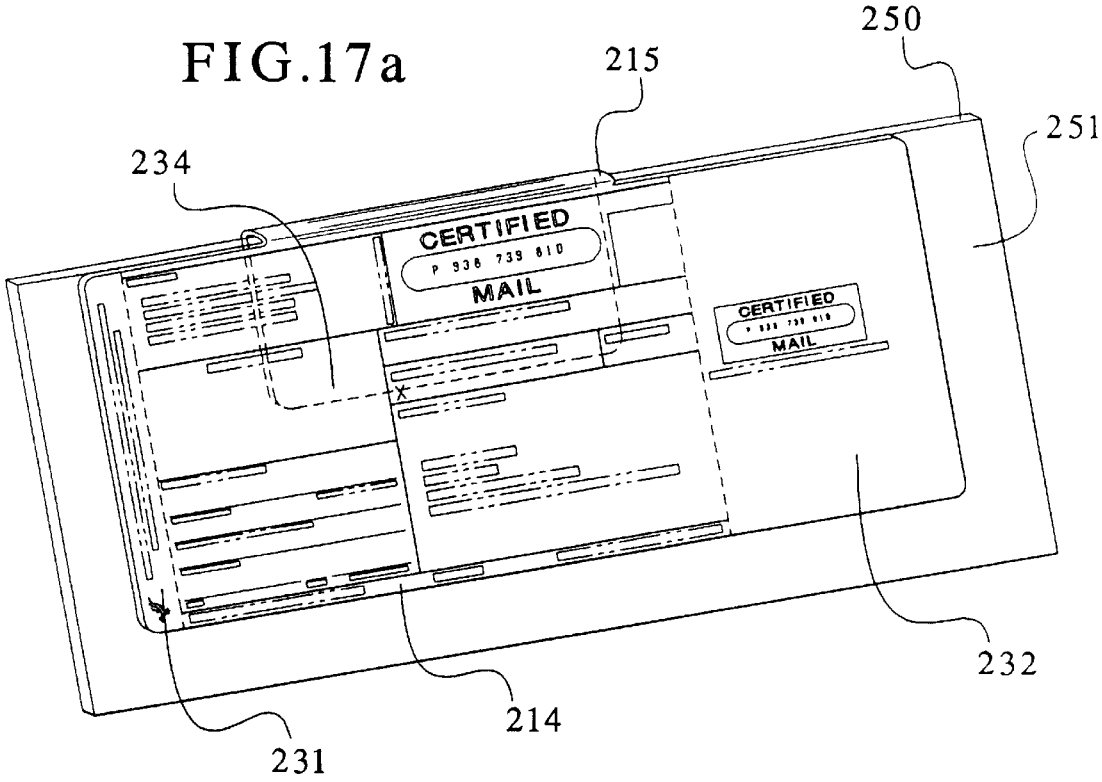
FIG. 17*a* illustrates a perspective view of an embodiment of a front or address side of a mailpiece or shipping item with attachment of a portion of the label/form required for special service mailing of the mailpiece, a return address section folded back upon a back side of the mailpiece.

In another embodiment of the present invention, as shown in FIG. 17*a*, the return address label 234 remains affixed to the remainder of the label/form 210 but is folded over, and affixed to, the back side of the article 250. More specifically, after the first and second anchor sections 231,232 and return postcard 214 are attached to the front side 251 of the article 250, the return address label 233 is folded along fold line 215 so as to lay against the back side of the article 250.

Figure 17B:
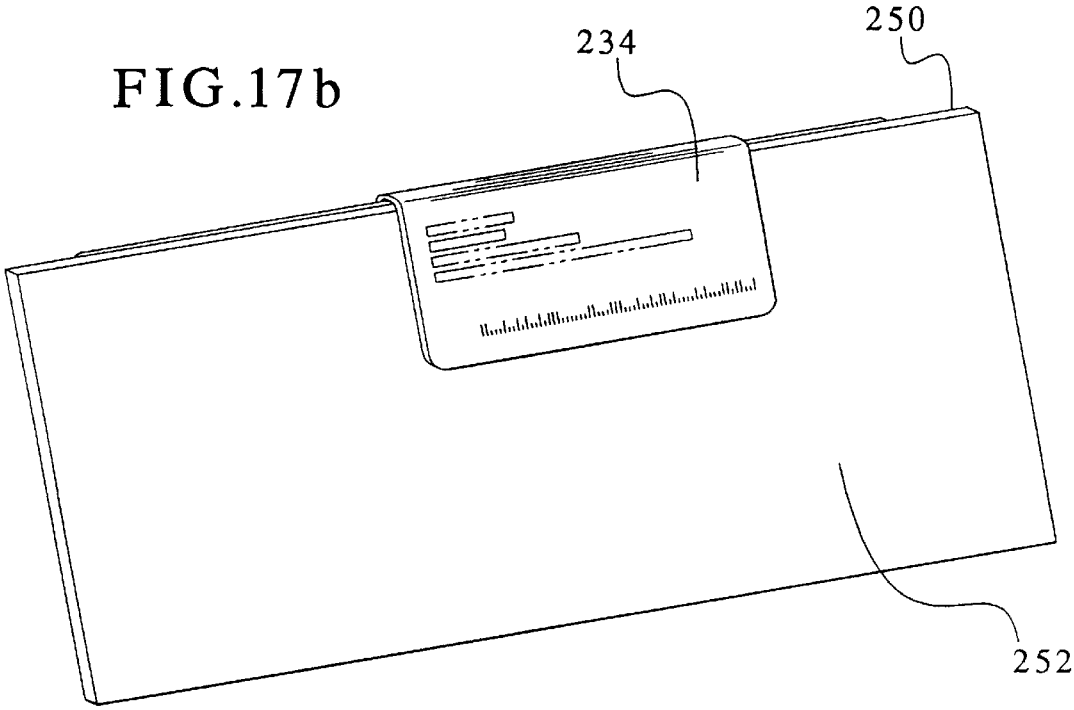
FIG. 17*b* illustrates a perspective view of an embodiment of the back side of the mailpiece from FIG. 17*a* showing the return address section folded back upon the back side of the mailpiece.

FIG. 17*b* illustrates a rear view of the article 250 after the return address label 234 has been folded over and affixed thereto. The positioning of the return address label 234 in this manner on the back side 252 of the article 250 allows it to serve as a standard return address label for mailing purposes.

Of course, the particular arrangement of the present invention is suitable for many types of mailpiece or shipping items requiring special service and for a variety of mailpiece or shipping items requiring special service mailing. Furthermore, printing of the label/form may be conducted in any known manner, such as by hand, by feeding the sheet through a printer, or by a continuously fed printer being either an impact or non-impact type. The present invention is not to be limited in the manner in which the label/form itself is printed as the same may be implemented by those skilled in the art.

Figure 18:
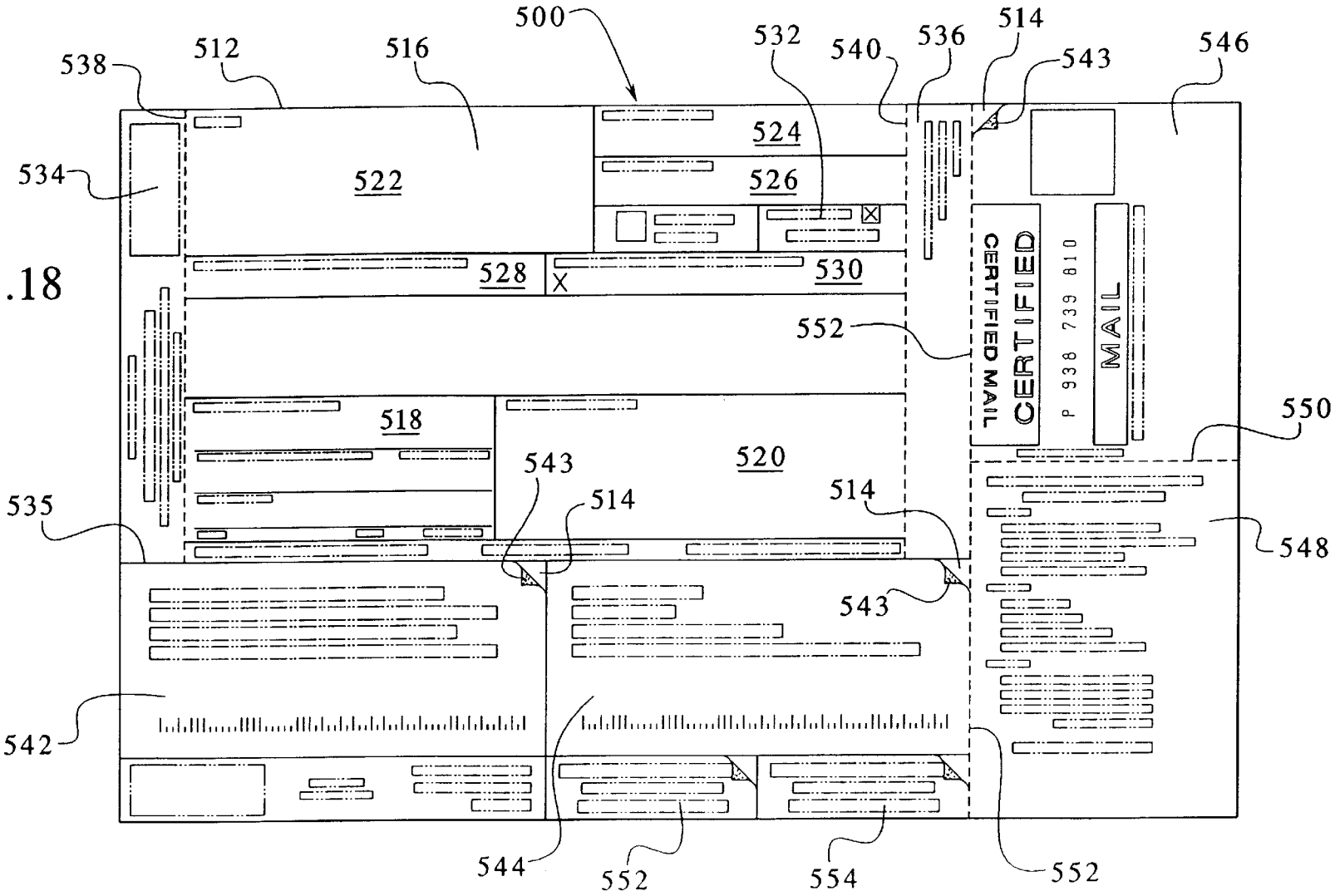
FIG. 18 illustrates a plan view of an embodiment of a front side of a label/form for special service mailing/shipping of a mailpiece or shipping item.
Figure 19:
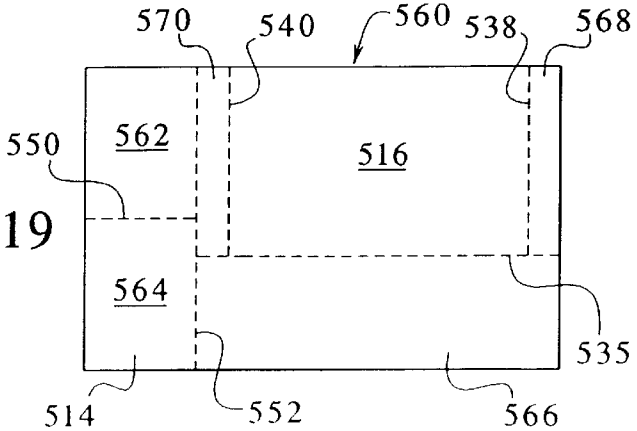
FIG. 19 illustrates a plan view of an embodiment of a back side of a label/form for special service mailing/shipping of a mailpiece or shipping item.

The label/form 500 illustrated in FIG. 18 includes a front layer 512 and a backing layer 514. The label/form 500 may include a plurality of detachable parts that may be defined by tear lines, score lines, or perforations that may extend through the front layer 512, or through the front layer 512 and the backing layer 514, as illustrated in FIGS. 18 and 19. Generally, the front layer 512 may include a return postcard 516 and may generally be the same as is illustrated in FIGS. 8 and 12. The return postcard 516 may include a plurality of sections for information to be added by hand or by a printer device. The return postcard 516 may include an addressee address section 518, an article addressed to section 520, a sender address section 522, a date of delivery section 524, an article number section 526, a "received by" section 528, a signature section 530 and a "service type" section 532. The present invention is not meant to be restricted by the information carried on the return receipt postcard.

On opposite ends of the return postcard 516 may be two anchor portions 534 and 536. The return postcard 516 may be separable from the anchor portions 534 and 536 via tear lines 538 and 540, respectively. The return postcard 516 and the anchor portions 534,536 may be detachable from a remainder of the label/form 500 via tear lines 535 and 537.

A return address section 542 for the return postcard 516 may be provided disposed adjacent to the return postcard 516. The return address section 542 may be a peel-and-stick type label. The return address section 542 may contain an adhesive on a backside of the return address section 542 and may be removably attached to the backing layer 514. In use, the return address section 542 may peel off the backing layer 514 and may be placed on the backside of the return postcard 516.

An addressee label section 544 may also be provided adjacent to the return postcard 516 although the positions of the detachable label sections are not meant to limit the invention in any way. The addressee label section 544 may also be a peel-and-stick type label which may contain an adhesive 543 on an underside of the addressee label section 544. The addressee label section 544 may be removed from the label/form 510 and placed on the article to be mailed.

A special services designator section 546 may be provided adjacent the return postcard 516. The special services designator section 546 may be a peel-and-stick type label that may contain the adhesive 543. The designator section 546 may peel off the backing layer 514 and may be placed on the article to be mailed by a special service. A receipt section 548 may be disposed adjacent the designator section 546 and may be separable from the designator section 546 via a tear line 550. The tear line 550 may extend through both the front layer 512 and the backing layer 514. Both the designator section 546 and the receipt section 548 may be separable from the remainder of the label/form 500 via a tear line 552. The tear line 552 may extend through both the front layer 512 and the backing layer 514.

In use, the label/form 500 may be printed upon by hand or by a printer. The printer may be any commonly known in the art, including, but not limited to, impact-type printers, ink jet printers, thermal printers and the like.

The designator section 546 and the receipt section 548 may be removed together from a remainder of the label/form 500 via the tear line 552. A backing layer section 564 of the backing layer 514 (as shown in FIG. 19) may then be removed from only the designator section 546 whereupon both the designator section 546 and the receipt section 548 may be placed on the article to be mailed in a location identifying the article to be delivered by a special service.

The receipt section 548 may remain attached to the designator section 546 until the receipt section 548 is, for example, date-stamped by the U.S. Postal Service whereupon the receipt section 548 may be detached from the designator section 546 via the tear line 550 and may be retained by the sender of the article. The return postcard 516 may then be removed from a remainder of the label form 500. The return address section 542 may be removed from the backing layer 514 and may be placed upon the backside of the return postcard 516 to aid in the delivery of the return postcard 516 to the sender after delivery of the article by the special service. The addressee section 544 may be removed from the label/form 500 and placed upon the article to aid in the delivery of the article by the special service.

The label/form 500 may also include a plurality of extra label sections 552,554 containing the article number to be retained by the sender for the sender's records. The extra sections 552,554 may also be peel-and-stick type label sections that may peel from the backing layer 514.

Of course, the particular arrangement of the present invention is suitable for many types of mailpieces or shipping items requiring delivery by a special service. The present invention is not to be construed as to the manner in which the label/form 500 is arranged or printed. Nonetheless, the unique arrangement of the components of the label/form 500 provides a simplified manner to print and use the label/form 500.

FIG. 19 illustrates a plan view of a backside 560 of the label/form 500. Generally, the backside 560 of the label/form 500 may include a backing layer 514 disposed over the entire backside 560 of the label/form 500. The designator section 546 may include a backing layer section 562 which is a part of the backing layer 514. Disposed adjacent the backside of the designator section 562 may be the backing layer section 564 for the receipt section 548. Both of the backing layer sections 562,564 may be separable from a remainder of the backing layer 514 via the tear line 552. The backing layer section 562 may be separable from the backing layer section 564 via the tear line 550.

As shown in FIG. 19, the tear lines 535, 538 and 540 may extend through the backing layer 514. Anchor portion backing layers 568, 570 may be part of the backing layer 514.

Figure 20:
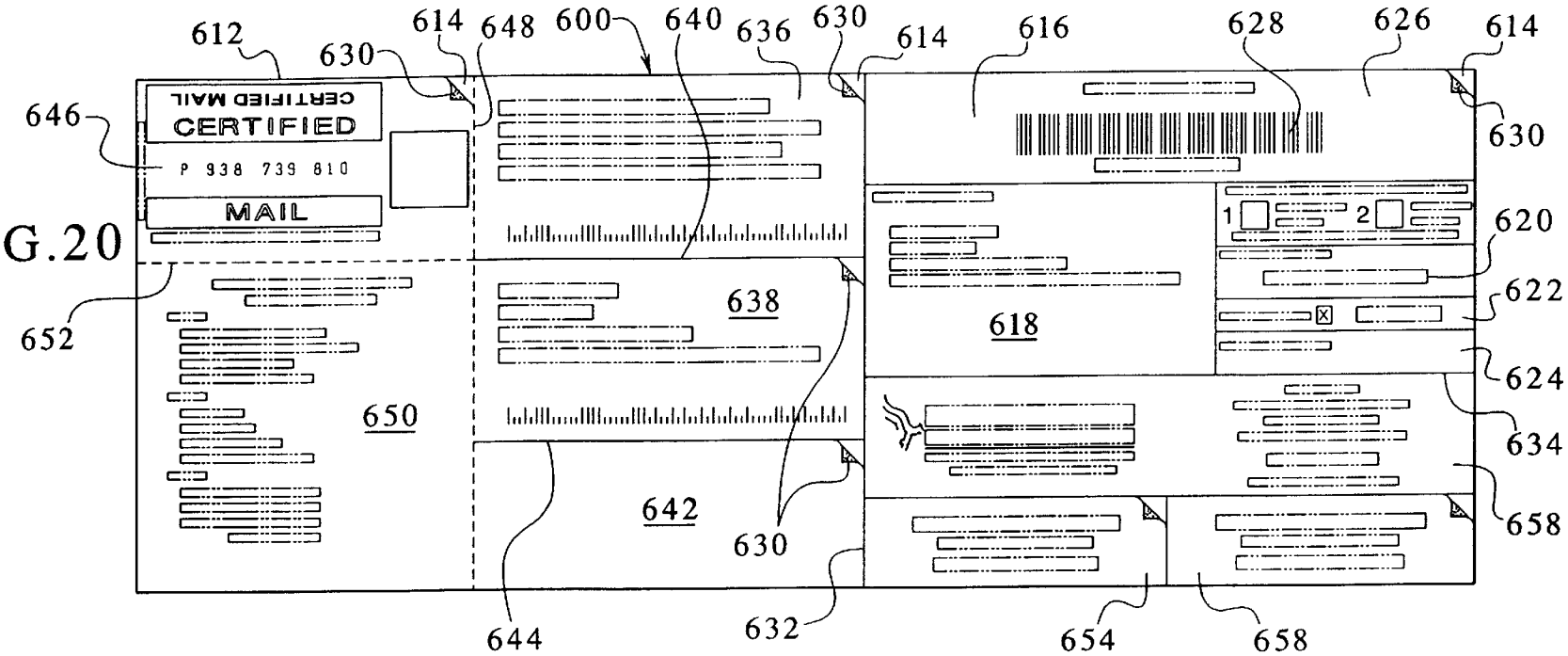
FIG. 20 illustrates a plan view of an embodiment of a front side of a label/form to be utilized with a return postcard for special service mailing/shipping of a mailpiece or shipping item.

FIG. 20 illustrates a label/form 600 which may contain a front layer 612 and a backing layer 614. A return receipt information section 616 may be provided on the label form 610. The return receipt information section 616 may contain the same information as required on a special services return postcard, such as, for example, the return postcard 516 as shown in FIG. 18. The return receipt information section 616 may contain the following sections, although other sections are contemplated as may be required for delivery by a particular special service: an addressee section 618, an article section 620, a service type section 622, a date of delivery section 624 and a machine readable bar code section 626. A machine readable bar code 628 may be printed or pre-printed within the machine readable bar code section 626. The return receipt information section 616 may be removably attached to the backing layer 614 via an adhesive 630 disposed on a backside of the return receipt information section 616. The return receipt information section 616 may be detachable from a remainder of the label/form 600 via tear lines 632,634.

In use, the return receipt information section 616 may be peeled or removed from the backing layer 614 and placed on a return postcard (not shown) corresponding to U.S. Postal Service form 3811. The return receipt information section 616 may correspond with information sections on the return postcard.

A return address section 636 may be provided on the label/form 600. The return address section 636 may contain information corresponding to where the return postcard should be delivered following delivery of the article by the special service. The return address section 636 may be removable from a remainder of the label/form 600 via tear lines 640, 632 and 648. The tear line 648 may extend through both the front layer 612 and the backing layer 614. The return address section 636 may be a peel-and-stick type label removably attached to the backing layer 614 via the adhesive 630. In use, the return address section 636 may be peeled or removed from the backing layer 614 and placed on a backside of the return postcard (not shown) to aid in the delivery of the return postcard.

Figure 21:
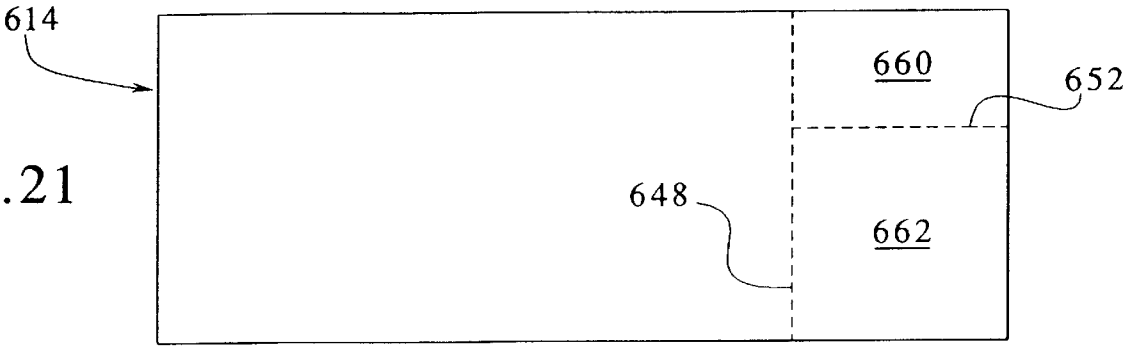
FIG. 21 illustrates a plan view of an embodiment of a back side of a label/form to be used with a return receipt postcard for special service mailing/shipping of a mailpiece or shipping item.

An addressee address section 638 may be provided on the label/form 600 via tear lines 640, 648 and 644 and may be peelable from the backside layer 614 via tear lines 640, 632, 648 and 644. The tear lines 640, 632 and 644 may extend through the front layer 612 of the label/form 600 and not through the backing layer 614. The tear line 648 may extend through both the front layer 612 and the backing layer 614, as shown in FIG. 21. In use, the addressee address section 638 may be peeled or removed from the backing layer 614 and placed upon the article to aid in the delivery of the article by the special service.

An optional label section 642 may be provided on the label/form 600. The optional label section 642 may be peelable from the backing layer 614 via the tear lines 644, 632 and 648. The tear lines 644 and 632 may extend through only the front layer 612 of the label/form 600. The optional label section 642 may be used by the sender of the article to aid in the delivery of the article by the special service. For example, the optional label 642 may contain an electronic postage designation, such as an E-stamp, or other like designation. It should be noted that the label sections 636, 638 and 642 are not to be limited in the manner herein described. The label sections 636,638 and 642 may be utilized in any way apparent to those skilled in the art.

A special services designator section 646 may be provided on the label/form 600 and may be detachable from a remainder of the label/form 600 via tear lines 648 and 652. Both of the tear lines 648,652 may extend through both the front layer 612 and the backing layer 614. A receipt section 650 may be provided adjacent the special services designator section 646 and may be detachable from the designator section 646 via the tear line 652. The designator section 646 may be a peel-and-stick type label removably attached to the backside 614 via the adhesive 630.

FIG. 21 shows a backing layer 614 including a backing layer section 660 provided on a backside of the designator section 646 and a backing layer section 662 provided on a backside of the receipt section 650. The backing layer sections 660 and 662 may be detachable from one another via the tear line 652 and may be removable from a remainder 664 of the backing layer 614 via the tear line 648.

In use, the designator section 646 and the receipt section 650 may be removed from a remainder of the label/form 600 via the tear line 648. The backing layer 614 is removed exposing only the adhesive 630 on the designator section 646. The designator section 646 may then be placed on the article to be mailed. The receipt section 650 may be removed from the designator section 646 after, for example, the Post Office has date-stamped the receipt section 650. The receipt section 650 may then be retained by the sender as a receipt.

Auxiliary labels 654,656 may be provided and may contain the mailpiece number to be retained by the sender to aid the sender in tracking the article during delivery. A supplemental section 658 may be provided and may contain information to aid in the delivery of the article by the special service or may contain other information such as, for example a company logo or company address.

Figure 22:
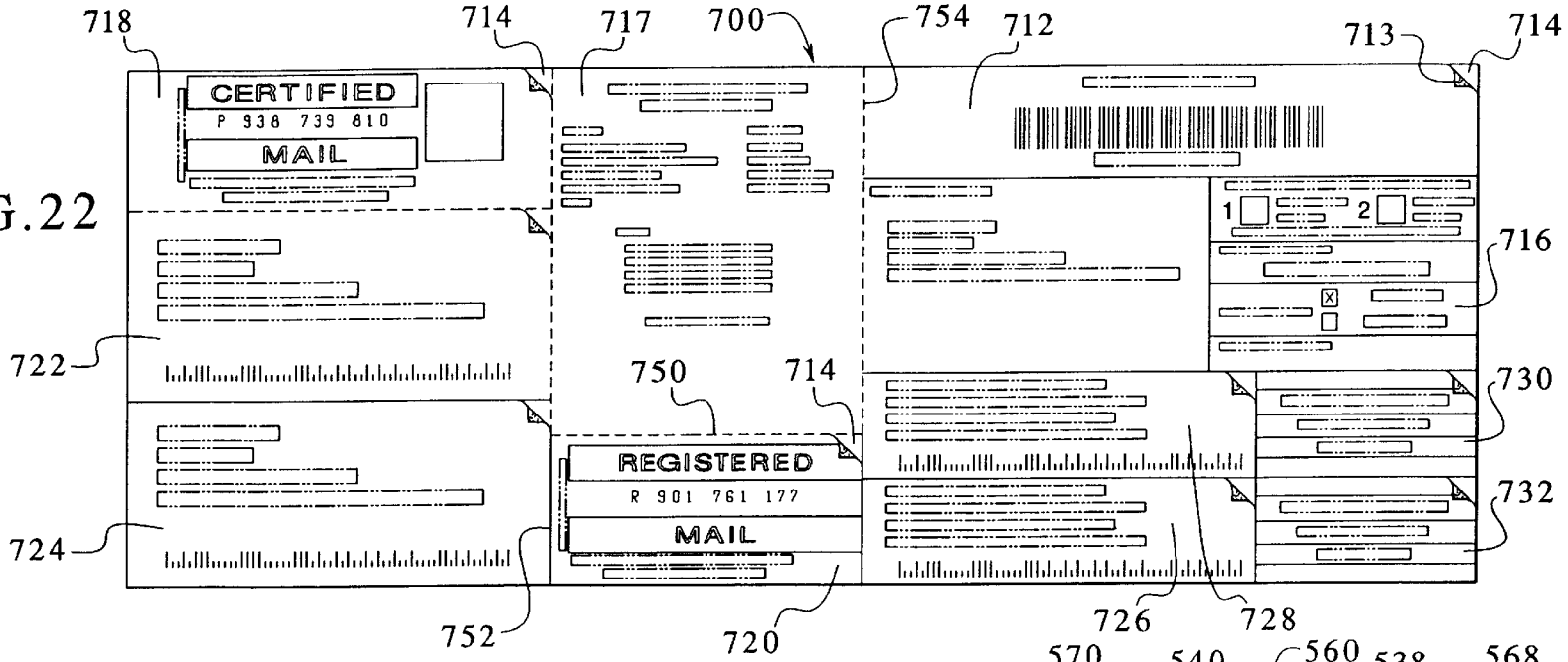
FIG. 22 illustrates a plan view of an embodiment of a front side of a label/form having alternative special service designators for special service mailing/shipping of a mailpiece or shipping item.

FIG. 22 illustrates a label/form 700 having a plurality of detachable parts including a return receipt information section 712 containing a plurality of sections. The return receipt information section 712 may be a peel-and-stick type label containing an adhesive 713 on a backside of the return receipt section 712. The return receipt section 712 may be removably attached to a backing sheet 714. The return receipt information section 712 may contain information required on a special service return postcard. In particular, the return receipt information section 712 may contain a service type designation section 716 in which a sender may specify whether the article is to the delivered by one of two or more special services, such as, for example, certified mail or registered mail. This embodiment does not limit the special services to certified mail or registered mail. Any special service may be utilized and provided for on the return receipt information section 712. In use, the return receipt information section 712 may be peeled or removed from the backside layer 714 and attached to a return postcard (not shown).

Attached to the label/form 700 may be a first special services designation section 718 corresponding to one particular service, such as, for example, certified mail. Further, also removably attached to the label/form 700 may be a second special services designation section 720 corresponding to another particular special service, such as, for example, registered mail. Removably attached to both the first special services designation section 718 and the second special services designation 720 may be a receipt section 717. The first special services designation section 718 may be removably attached to the receipt section 717 via the tear line 752. Further, the second special services designation section 720 may be removably attached to the receipt section 717 via the tear line 750. Both the receipt section 717 and the first special services designation section 718 may be removable from a remainder of the label/form 700 to be applied to a mailpiece for non-domestic delivery thereof.

If the sender of the mailpiece wishes to send the mailpiece by a first special service, such as, for example, certified mail, the sender may remove the first special services designator section 718 and the receipt section 717 and may keep the first special services designator 718 and the receipt section 717 attached together via the tear line 752. The first special service may correspond to the first special services designator section 718. Further, if the sender wishes to send the mailpiece by a second special services, such as, for example, registered mail, the sender may peel or remove the second special services designator section 720 from the label/form 700 and apply it over the first special services designator section 718.

The first special services designator section 718, the second special service designator section 720 and the receipt 717 may then be applied to a mailpiece by peeling or removing the first special services designator section 718 from the backing layer section 742 with or without the second special services designator section 720. The backing layer section 746 may remain attached to the receipt section 717. The first special service designator section 718 may then be applied to a mailpiece, such as, for example, in a conspicuous location so as to be readily identified as requiring delivery by a special service. The U.S. Postal Service may then date-stamp the receipt section 717 whereupon the sender may remove the receipt section 717 and retain it for his or her records.

The label/form 700 may include a plurality of auxiliary labels 722, 724, 726 and 728. The auxiliary labels 722, 724, 726 and 728 may be utilized in any manner apparent to those skilled in the art.

Auxiliary designator sections 730,732 may be provided. The auxiliary designator section 730 may correspond to a first special service, such as, for example, certified mail. Auxiliary designator section 732 may correspond to a second special service, such as, for example, registered mail. These auxiliary designator sections 730,732 may be peel-and-stick type labels containing an adhesive 713 and removably attached to the backing layer 714. These auxiliary label sections 730,732 may be used by the sender in any manner apparent to those skilled in the art to aid in the delivery of the article by a special service.

The label/form 700 may be provided as a "blank" form whereupon the sender chooses whether to send the article by one of two special services. For example, the special service may be certified mail or registered mail. The information relating to the delivery of the article by the special service chosen may then be printed on the label/form 700 by hand or any type of printing device apparent to those skilled in the art.

Further, two or more label/forms 700 may be provided removably attached to one another. The attachment of multiple label/forms 700 together may allow the assembly to measure 8½"×11" to aid in the storage and/or printing of the label/form 700 by, for example, a printing device.

Figure 23:
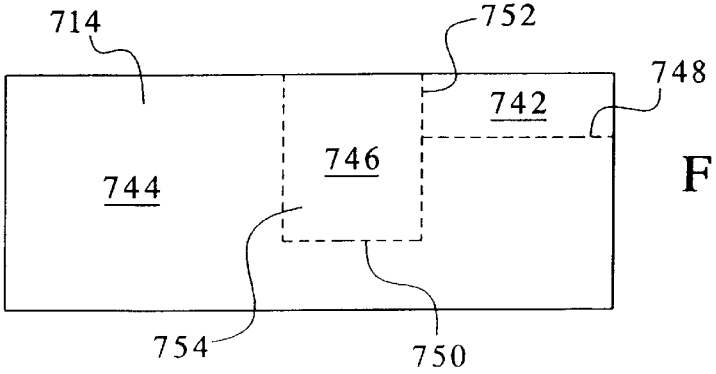
FIG. 23 illustrates a plan view of an embodiment of a back side of a label/form having alternative special service designators required for special service mailing/shipping of a mailpiece or shipping item.

FIG. 23 shows the backing layer 714 of the label/form 700 indicating the various tear lines that extend through both of the label/form 700 and the backing layer 714. The backing layer section 742 may be attached to the backside of the first special services designator section 718. The backing layer section 746 may be attached to the backside of the receipt section 717. The backing layer section 742 may be separable from a remainder of the backing layer section 714 via the tear line 748. The backing layer section 744 may further be detachable from the backing layer section 746 via the tear lines 750, 752 and 754. The backing layer section 746 may be removable from the certified mail designator section 718 via the tear line 752.

Figure 24:
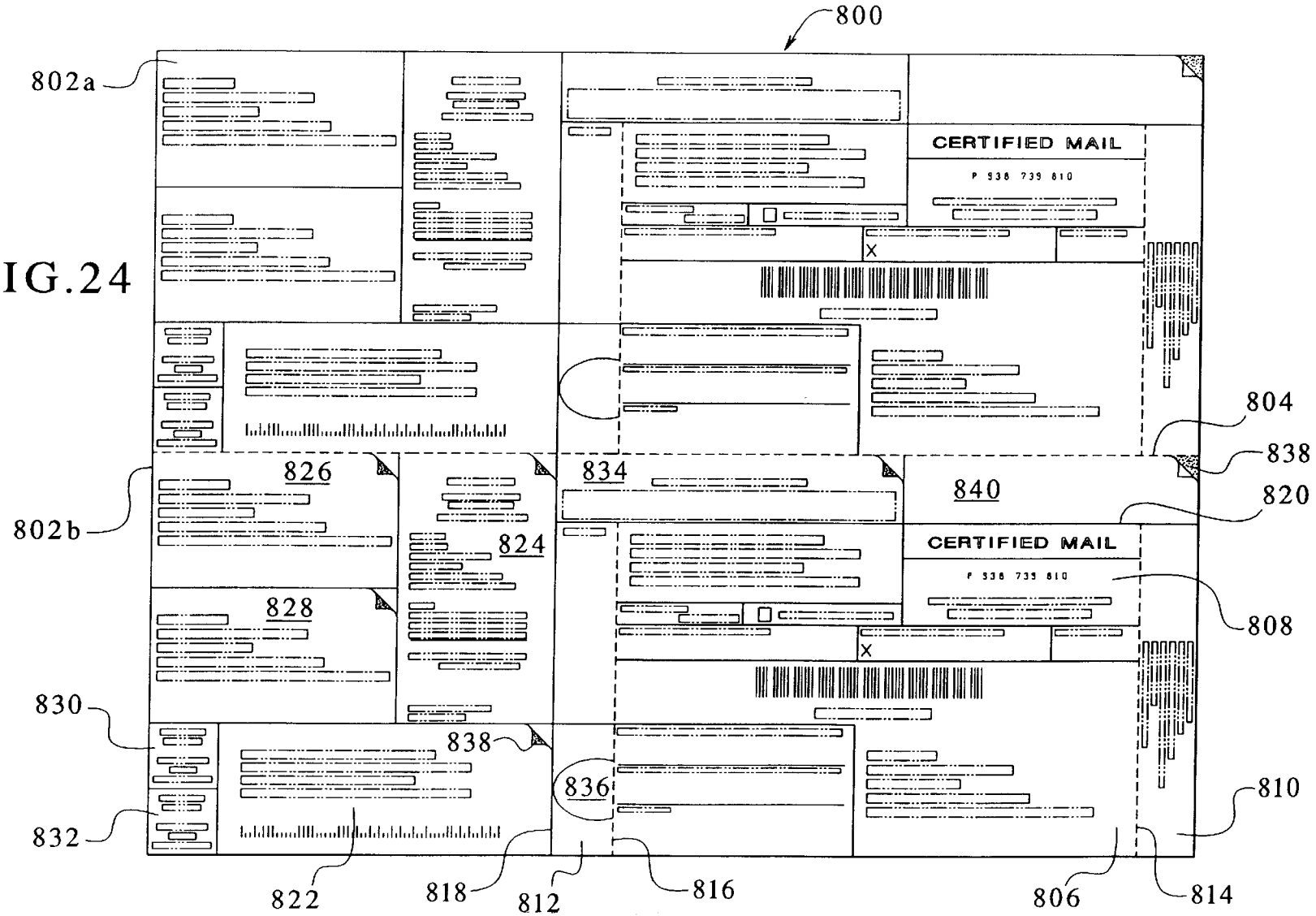
FIG. 24 illustrates a plan view of an embodiment of a front side of a sheet having two special service mailing forms attached on a single sheet.

Referring now to FIG. 24, a sheet 800 is illustrated having two special service mailing forms 802*a*, 802*b* removably attached to each other via a tear line 804. The two special service mailing forms 802*a*, 802*b* may be identical in nature having intrinsically the same parts. Reference to one single form 802*a* or 802*b* will hereinafter be indicative of either. However, the forms 802*a*,802*b* may be varied with respect to each other without diminishing the attendant advantages of the present invention.

The mailing form 802*a* or 802*b* may contain a return postcard 806 having a special services designator section 808. The special services designator may be indicative of any special service required by a sender of an article such as certified mail, registered mail, insured mail, recorded delivery mail, return receipt for merchandise mail, C.O.D. or the like. The return postcard 806 may have anchor portions 810,812 removably attached on opposite sides of the return postcard 806 via tear lines 814,816, respectively. The return postcard 806 and anchor portions 810, 812 may be removed from a remainder of the form 802*a* or 802*b* via the tear lines 818,820. Upon removal of the return postcard 806 and anchor portions 810,812 from the remainder of the form 802*a* or 802*b*, the return postcard 806 and anchor portions 810,812 may be affixed to an article requiring delivery by the special service indicated in the designator section 808.

A plurality of auxiliary labels 822, 824, 826, 828, 830, 832 and 834 may be provided on a remainder of the form 802*a* or 802*b* to aid in the delivery of the article by the special service. The auxiliary label 822 may be used as a return address label for the return postcard 806. The auxiliary label 822 may peel from a backing layer 850 (as shown in FIG. 19) whereupon the auxiliary label 822 may fold along the tear line 816 and adhesively affix to the back side of the return postcard 806 becoming a return address label for the return postcard 806. A tab 836 may remain to be affixed to the article to be delivered by the special service.

The auxiliary label 824 may be configured to act as a mailing receipt. A sender of the article may get the auxiliary label 824 date-stamped by the deliverer of the article and the sender may retain the auxiliary label 824 for his or her records. The auxiliary labels 826 and 828 may be used as address labels for the return postcard 806 or the article (not shown) to be delivered by the special service. The auxiliary labels 830,832 may be used by the sender to retain as a record of delivery of the article by the special service. Auxiliary label 834 may be used as an extra label for instructions to be printed thereon or for other like uses. It should be noted that the labels may be used in any manner to aid in the delivery of the article by a special service and should not be limited as herein described.

Figure 25:
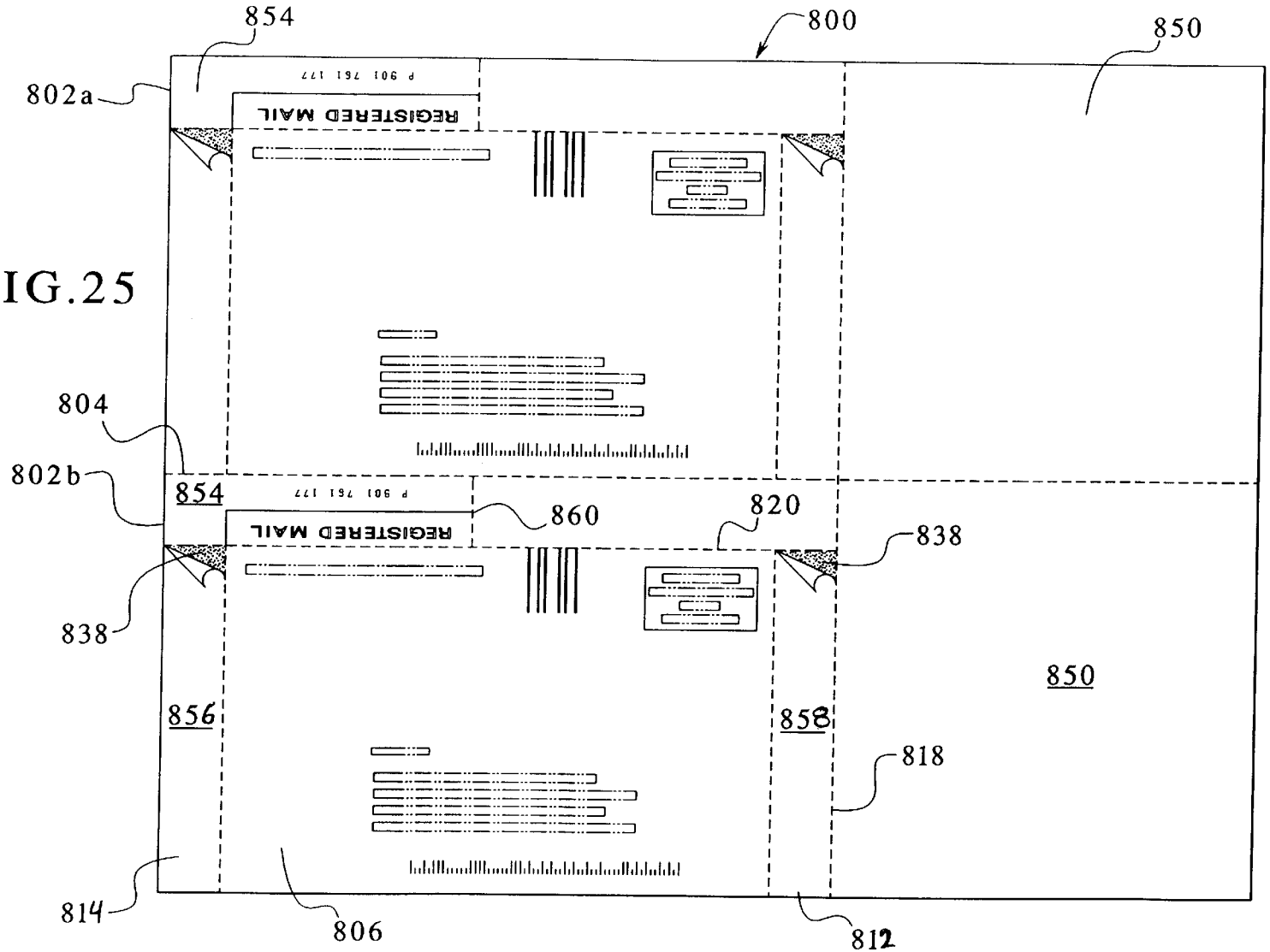
FIG. 25 illustrates a backside view of an embodiment of the present invention.

Each auxiliary label 822, 824, 826, 828, 830, 832 and 834 may be peeled off the backer 850 (as shown in FIG. 25). An adhesive 838 may be provided on backsides of the auxiliary labels 824, 826, 828, 830, 832 and 834. Each auxiliary label 824, 826, 828, 830, 832 or 834 may be peeled from the backer 850 and affixed in any way that may aid in the delivery of the article by the special service.

A front side backing layer 840 may be provided on the front side of the form 802*a* or 802*b*. An individual may peel the front side backing layer 840 from the front side of the form 802*a* or 802*b* and may expose the adhesive 838 that remains on the backside of the second special services designator 854 as shown in FIG. 25. The second special services designator section 854 may be folded along tear line 820 to partially cover the special services designator 808 thereby changing the special service to be utilized in the mailing of the article.

For example, the second special services designator section 854 may refer to registered mail. The special services designator section 808 may refer to certified mail. If the sender of the article desires that the article be sent by registered mail, then the backing layer 880 is peeled from the front side of the form 802*a* or 802*b* exposing the adhesive 838. The second special services designator section 854 is folded downward via the tear line 820 to cover the certified mail designator section 808 thereby changing the special service desired from certified mail to registered mail. Alternatively, if the sender does not wish to change the special service of the article, then the sender may tear along the tear line 820 thereby separating the return postcard 806 from the second special service designator 854.

Further, FIG. 25 shows a backside view of the sheet 800. Again, the sheet 800 consists of the two forms 802*a*, 802*b* removably attached to one another via the tear line 804. The backside of each form 802*a*, 802*b* has the backside of the return postcard 806 and the backsides of each anchor portion 810,812. The backsides of the anchor portions 810,812 include peelable backing layers 856,858, respectively, that may be removed from the backsides of the anchor portions 810,812 exposing the adhesive 838 that may be disposed on the anchor portions 810,812.

As previously noted, the backside of the form 802*a* or 802*b* may contain the second special services section 858 that may be folded down and adhesively affixed to the front side of the form 802*a* or 802*b* to change the special service of the article. The return postcard 806 and anchor portions 810,812 may be removed from the remainder of the form 802*a* or 802*b* via tear lines 818,820. A tear line 860 may be provided to separate the second special services designator section 854 from the form 802*a* or 802*b*.

The sheet 800 may be 8½" by 11" for ease of printing and storing thereof. However, any size sheet is contemplated as may be apparent to those skilled in the art. Further, only one form may be contained on the sheet 800.

Figure 26:
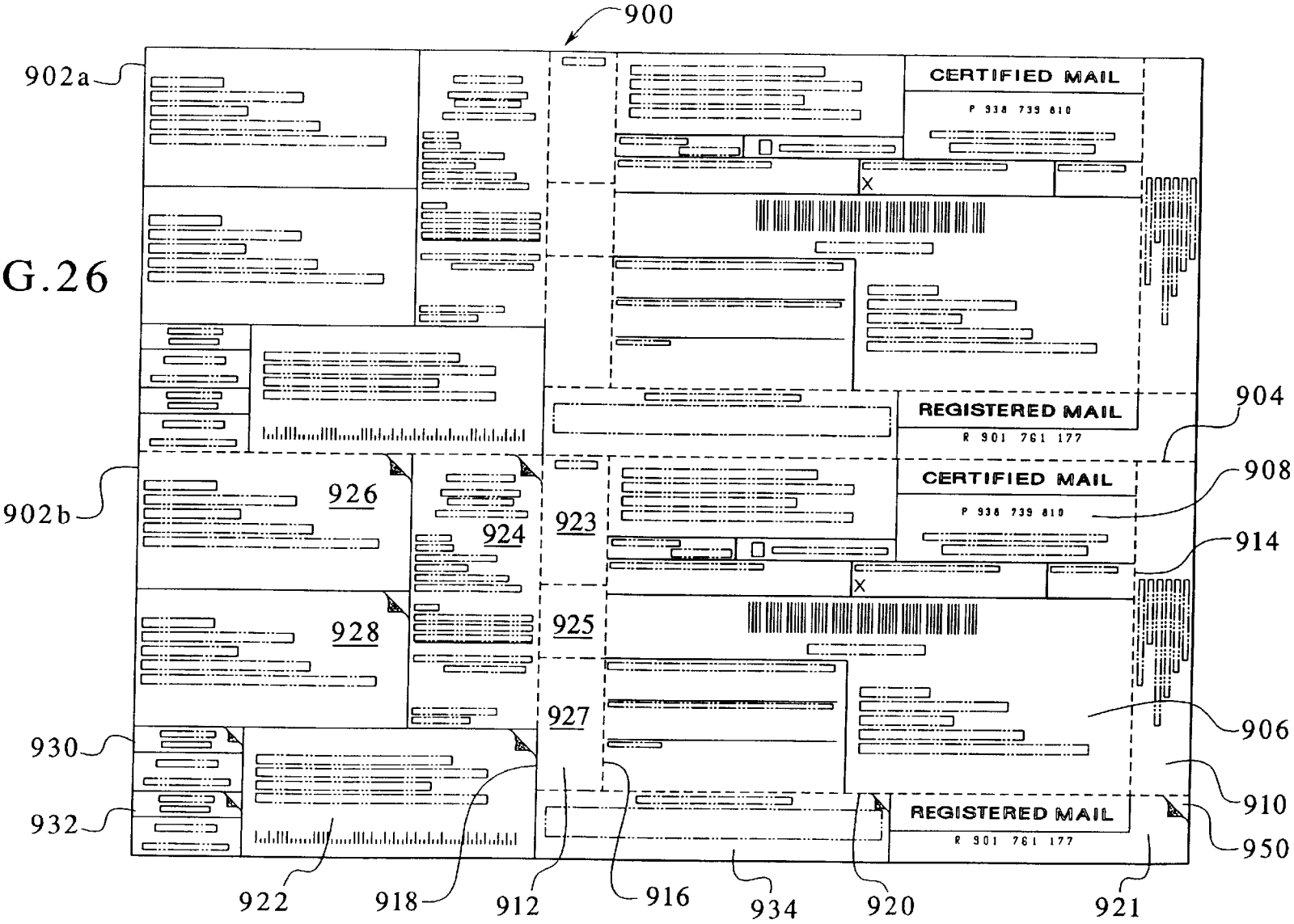
FIG. 26 illustrates a plan view of an alternate embodiment of the present invention including a return postcard and auxiliary labels.

FIG. 26 shows a sheet 900 including forms 902*a* and 902*b* removably attached to one another via a tear line 904. Each form 902*a* or 902*b* may contain a return postcard 906 including a special services designator section 908. Anchor portions 910,912 may be disposed on opposite sides of the return postcard 906 and may be removably attached to the return postcard 906 via tear lines 914,916. The return postcard 906 and anchor portions 910,912 may be removed from a remainder of the form 902*a* or 902*b* via tear lines 918,920. The form 902*a* or 902*b* may also contain a second special services designator section 921 that may be peelable from a backing layer 950 exposing an adhesive on the backside of the second special services designator section 921. After removal of the second special services designator section 921 from the backing layer 950, the second special services designator section 921 may then be adhesively affixed partially over the special services section 908 thereby changing the special service desired by the sender of the article.

The anchor portion 912 may be sub-divided into three extra labels 923, 925 and 927 that may be peeled from the backing layer 950 and used by the sender of the article to aid in the delivery of the article by the special service by adhering one or more of the extra labels 923, 925 and/or 927 to the mailpiece; by retaining one of the extra labels 923, 925 and/or 927 by the sender for the sender's records; or any other reason that may be apparent to those skilled in the art. The form 902*a* or 902*b* may also contain a plurality of auxiliary labels 922, 924, 926, 928, 930, 932 and 934. These auxiliary labels may be peelable from the backing layer 950 and utilized by the sender of the article to aid in the delivery of the article by the special service in the same manner as specified with respect to the auxiliary labels 822, 824, 826, 828, 830, 832 and 834 as described with reference to FIG. 24. However, the auxiliary labels 922, 924, 926, 928, 930, 932 and 934 may be used in any manner that may be apparent to those skilled in the art.

Figure 27:
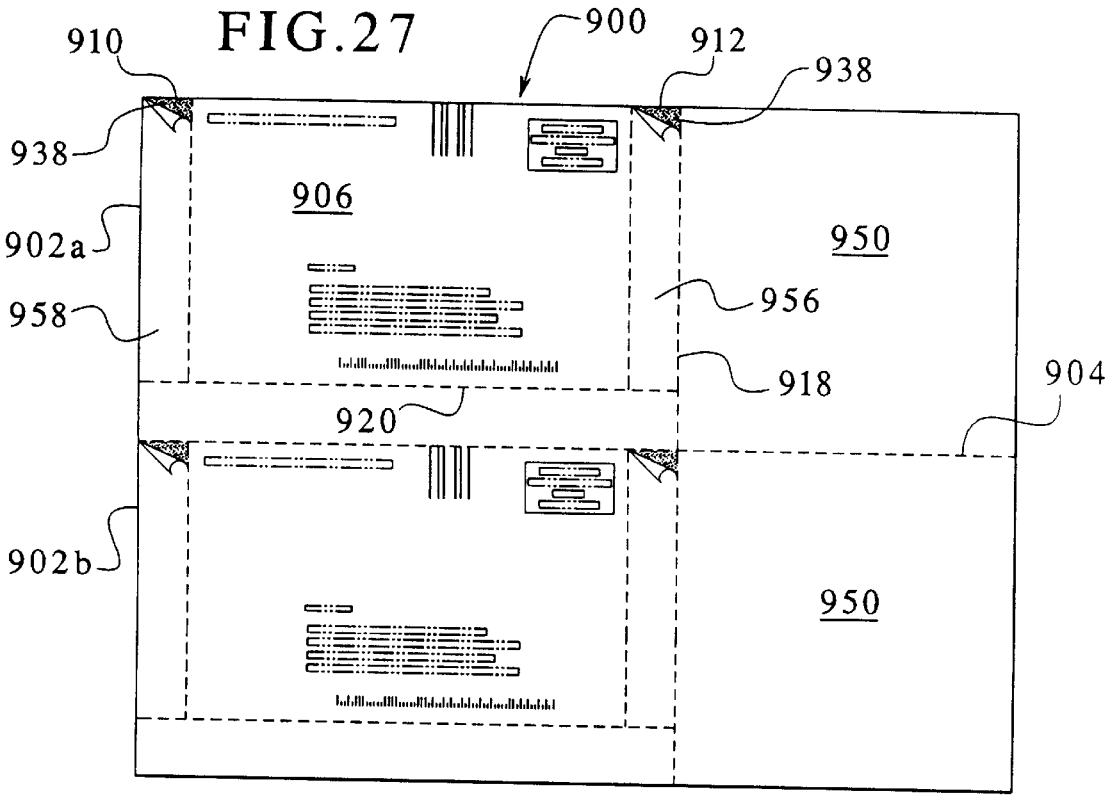
FIG. 27 illustrates a backside view of an embodiment of the present invention including a return postcard and peel-off backing strips.

FIG. 27 shows a backside view of the sheet 900 showing backsides of the return postcard 906 and anchor portions 910,912. The backsides of the anchor portions 910,912 may contain peelable backing layers 956,958 that may be peeled off the anchor portions 910,912 exposing the adhesive 938 whereby the return postcard 906 and anchor portions 910, 912 may be adhesively affixed to an article to be sent by a special service after removal from the mailing form 902*a* or 902*b*. The return postcard 906 and anchor portions 910,912 may be removed from the remainder of the form 902*a* or 902*b* via tear lines 918,920.

The sheet 900 may be an 8½"×11" sheet for ease of storage and ease in printing upon each form 902*a* or 902*b*. Of course, the sheet 900 may be any size and this invention should not be construed as limited as herein described. Further, the sheet 900 may contain only one form as well.

Figure 28:
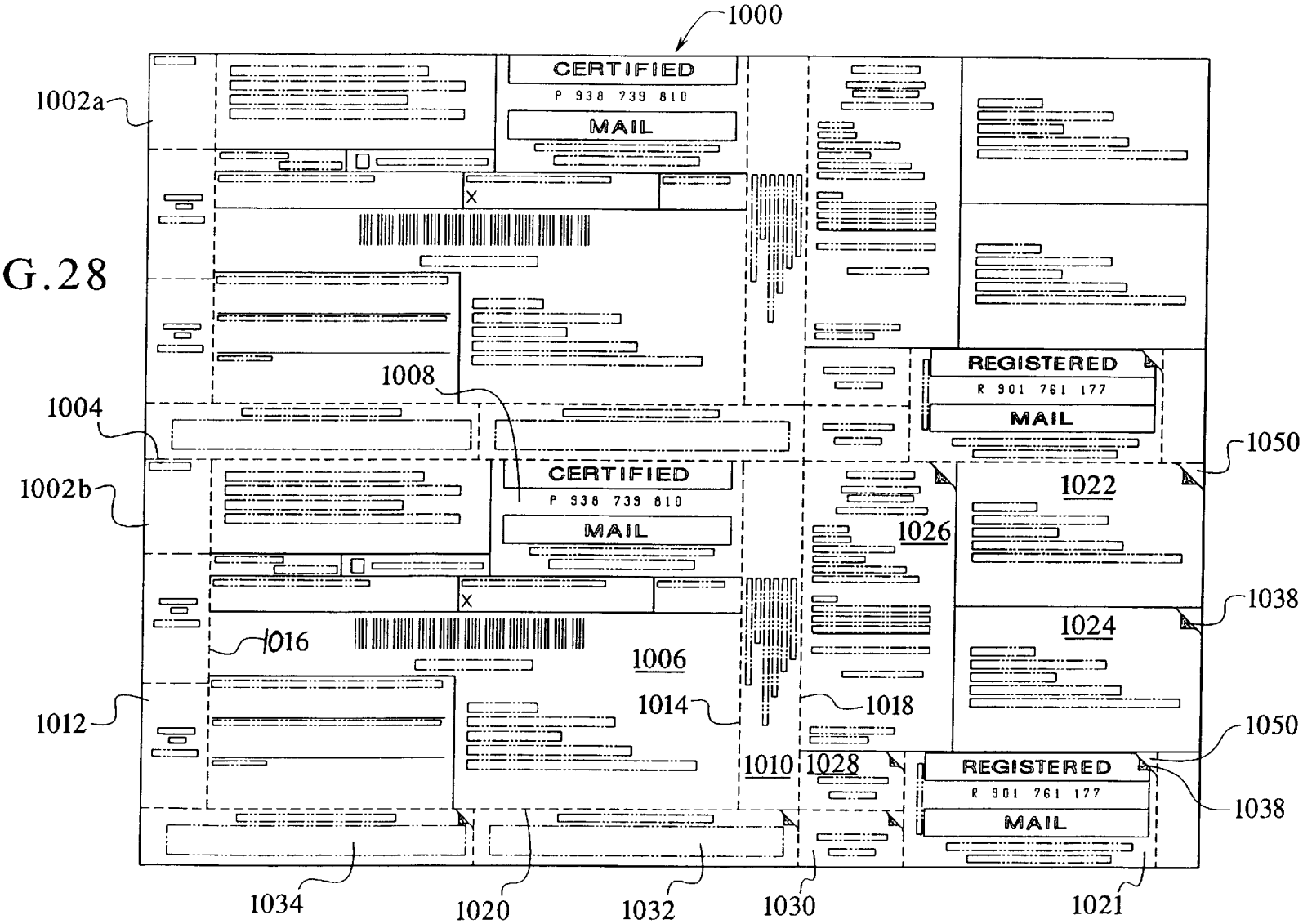
FIG. 28 illustrates another embodiment of the present invention including a return postcard and auxiliary labels.

FIG. 28 illustrates a sheet 1000 having two forms 1002*a* or 1002*b* removably attached to one another via a tear line 1004. Each form 1002*a* or 1002*b* may contain a return postcard 1006 having a special services designator section 1008. The return postcard 1006 may have anchor portions 1010,1012 and may be removably attached to the return postcard via tear lines 1014,1016. The return postcard may be removed from a remainder of the form 1002*a* or 1002*b* via tear lines 1018,1020.

A second designator section 1021 may be disposed on the form 1002*a* or 1002*b* and may be peelable from a backing layer 1050 exposing an adhesive 1038. The second designator section 1021 may be peeled from the form 1002*a* or 1002*b* and adhesively affixed over the special services designator section 1008 thereby changing the special service desired by the sender of the article.

A plurality of auxiliary labels 1022, 1024, 1026, 1028, 1030, 1032 and 1034 may be removably attached to a backing layer 1050 via the adhesive 1038 and may be utilized by the sender of the article to aid in the delivery of the article by the special service. The plurality of auxiliary labels 1022, 1024, 1026, 1028, 1030, 1032 and 1034 may be used in any manner that may be apparent to those skilled in the art to aid in the delivery of the article by the special service.

Figure 29:
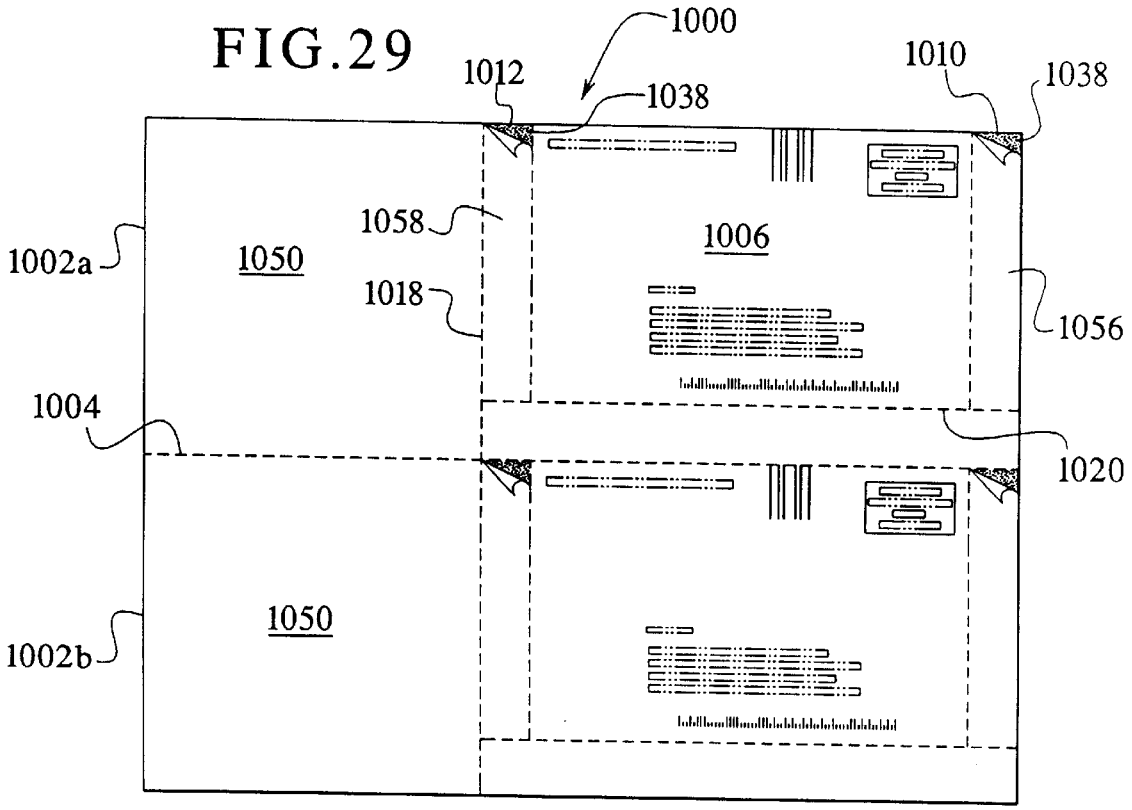
FIG. 29 illustrates a backside view of an embodiment of the present invention including a return postcard.

FIG. 29 shows a backside view of the sheet 1000 including the forms 1002*a* or 1002*b* removably attached to one another via the tear line 1004. The backside of the return postcard 1006 may have the anchor portions 1010,1012 disposed on opposite sides of the return postcard 1006. The return postcard 1006 and the anchor portions 1010,1012 may be removable from a remainder of the form 1002*a* or 1002*b* via the tear lines 1018,1020. The anchor portions 1010,1012 may contain backing layers 1056,1058 that expose the adhesive 1038 when removed. As indicated previously, the backside of each form 1002*a* or 1002*b* may contain a backing layer 1050.

As previously noted with respect to other embodiments of the present invention, the sheet 1000 may be an 8½"×11"

sheet thereby aiding in the storage and printing of information upon the forms 1002*a* or 1002*b*. However, the sheet may be any size as may be apparent to those skilled in the art. Further, the sheet 1000 may contain only one form.

It should be understood that various changes and modifications to the presently preferred embodiment described herein will be apparent to those skilled in the art. Such changes and modifications may be made with departing from the spirit and scope of the present invention and without diminishing its attendant advantages. It is, therefore, intended that such changes and modifications be covered by the appended claims.

I claim:

1. A mailing assembly for shipping and handling an article requiring delivery by a special service, the mailing assembly comprising:

a return postcard having a first designator section indicative of a first special service wherein the first designator section has information related to the delivery of the article by the first special service; and a second designator section adjacent the return postcard wherein the second designator section is indicative of a second special service wherein the second designator section has information related to the delivery of the article by the second special service and further wherein the first special service is different than the second special service.

2. The assembly of claim 1 further comprising:

an anchor portion adjacent the return postcard and removably attached thereto.

3. The assembly of claim 2 further comprising:

a tear line disposed between the return postcard and the anchor portion.

4. The assembly of claim 2 wherein the anchor portion has a backside and further wherein a backing layer is disposed on the backside of the anchor portion.

5. The assembly of claim 2 wherein the anchor portion has a backside and further wherein an adhesive is disposed on the backside of the anchor portion.

6. The assembly of claim 1 further comprising:

an auxiliary label laterally disposed from the return postcard.

7. The assembly of claim 1 wherein the second designator section is on a back side of the assembly.

8. The assembly of claim 1 wherein the first designator section identifies certified mail and the second designator section identifies registered mail.

9. A method for preparing an article for delivery by a special service, the method comprising the steps of:

providing a mailing assembly having a first return postcard section wherein the first return postcard includes a first designator section indicative of a first special service wherein the first designator section has information related to the delivery of the article by the first special service;

providing a second designator section indicative of a second special service on the mailing assembly wherein the second designator section has information related to the delivery of the article by the second special service and further wherein the first special service is distinct from the second special service;

providing an anchor portion removably attached to the return postcard wherein the anchor portion has a backing layer disposed on a backside of the anchor portion; and printing information on the first return postcard for delivery of the article by the special service.

10. The method of claim 9 further comprising the step of:

removing the backing layer from the anchor portion and adhesively affixing the first return postcard and anchor portion to the article.

11. The method of claim 9 further comprising the step of:

adhesively affixing the second designator section to the first return postcard directly over the first designator section.

12. The method of claim 9 further comprising the step of:

providing an auxiliary label having a backing layer laterally disposed from the return postcard; and removing the auxiliary label from the backing layer.

13. The method of claim 12 further comprising the step of:

affixing the auxiliary label to the article.

14. The method of claim 12 further comprising the step of:

affixing the auxiliary label to the return postcard.

15. The method of claim 12 further comprising the step of:

configuring the auxiliary label as a mailing receipt.

16. The method of claim 9 further comprising the step of:

providing tear lines positioned between adjoining edges of the first return postcard section and the anchor portion; and detaching the return postcard from the anchor portion.

17. The method of claim 9 further comprising the steps of:

providing a second return postcard having a third designator section on the assembly and further wherein the second return postcard has a second anchor portion removably attached thereto;

providing a fourth designator section associated with the second return postcard; and printing information on the second return postcard.

18. An assembly for preparing and article for delivery by a special service, the assembly comprising:

a multilayer sheet wherein the sheet includes a first and a second return postcard and further wherein the first return postcard has a first designator section thereon wherein the first designator section is indicative of a first special service wherein the first designator section has information related to the delivery of the article by the first special service and further wherein the first return postcard has a second designator section associated therewith wherein the second designator section is indicative of a second special service wherein the second designator section has information related to the delivery of the article by the second special service and further wherein the second return postcard has a third designator thereon wherein the third designator is indicative of the first special service and further wherein the second return postcard has a fourth designator section associated therewith wherein the fourth designator is indicative of the second special service.

19. The assembly of claim 18 further comprising:

a first anchor portion and a second anchor portion removably attached to the first return postcard and the second return postcard, respectively.

20. The assembly of claim 18 wherein the first special service identifies certified mail and the second special service identifies registered mail.

* * * * *

UNITED STATES PATENT AND TRADEMARK OFFICE

CERTIFICATE OF CORRECTION

PATENT NO. : 6,371,521 B1
DATED : April 16, 2002
INVENTOR(S) : Petkovsek

It is certified that error appears in the above-identified patent and that said Letters Patent is hereby corrected as shown below:

Column 8,
Line 4, change “typing” to read -- tying --

Column 10,
Line 16, change “adjacent top” to read -- adjacent to --

Column 11,
Line 12, change “213 ad a” to read -- 213 as a --
Line 64, change “attached.,” to read -- attached. --

Column 12,
Line 21, change “embodiment, the return Postcard,” to read -- embodiment, --

Column 19,
Line 31, change “118 o other” to read -- 118 or other --

Signed and Sealed this

Thirtieth Day of September, 2003

JAMES E. ROGAN
*Director of the United States Patent and Trademark Office*